US007398614B2

(12) United States Patent
Rozhkov et al.

(10) Patent No.: US 7,398,614 B2
(45) Date of Patent: Jul. 15, 2008

(54) FIREARM APPARATUS AND METHOD

(76) Inventors: Leonid Rozhkov, 236 Meadow Trail Dr., Highland Heights, KY (US) 41076; Igor Rozhkov, 45 Knyaz Ostrozhsky Street, Apt. 72, Ternopil (UA) 46001

( * ) Notice: Subject to any disclaimer, the term of this patent is extended or adjusted under 35 U.S.C. 154(b) by 35 days.

(21) Appl. No.: 11/415,789

(22) Filed: May 2, 2006

(65) Prior Publication Data

US 2006/0260461 A1 Nov. 23, 2006

Related U.S. Application Data

(60) Provisional application No. 60/677,382, filed on May 3, 2005.

(51) Int. Cl.
*F41A 3/00* (2006.01)

(52) U.S. Cl. ..... 42/2; 42/25; 89/1.701; 89/1.706

(58) Field of Classification Search ..... 42/25, 42/68, 2; 89/194, 196, 1.7, 1.706, 1.701, 89/1.704, 1.705
See application file for complete search history.

(56) References Cited

U.S. PATENT DOCUMENTS

| | | | |
|---|---|---|---|
| 797,420 | A | 8/1905 | Febiger |
| 1,343,444 | A | 6/1920 | Formby |
| 1,383,966 | A | 7/1921 | Oliver |
| 2,027,892 | A | 1/1936 | Williams |
| 2,090,656 | A | 8/1937 | Williams |
| 2,090,657 | A | 8/1937 | Williams |
| 2,336,146 | A | 12/1943 | Williams |
| 2,356,491 | A | 8/1944 | Loomis |
| 2,516,926 | A | 8/1950 | Simpson |
| 2,847,787 | A | 8/1958 | Williams |
| 2,920,537 | A | 1/1960 | Simmons |
| 3,547,001 | A | 12/1970 | Stoner |
| 4,541,193 | A | 9/1985 | Flippin |
| 5,309,815 | A | 5/1994 | Moller et al. |

OTHER PUBLICATIONS

Chechailyuk, Igor; Non-standard designations of automatic firearms; Firearms and Hunting, A Specialized firearms magazine, p. 8-10, 12(17), 2000, Ukraine Press, Kieve, Ukraine.

*Primary Examiner*—Michael J. Carone
*Assistant Examiner*—Gabriel J Klein
(74) *Attorney, Agent, or Firm*—Alfred J. Mangels

(57) ABSTRACT

A firearm apparatus and a method of firing ammunition therefrom, where the method utilizes a barrel (12) having a breech end surface (40) and immovably affixed to frame (10), a stand pressure surface (32), and a cartridge container (16) with a cartridge case (26) therein and countermass main body (18) movable in opposite directions. Gas from a deflagrating propellant moves the movable members and applies directionally opposite forces upon the breech end surface (40) and the stand pressure surface (32), which results in the force cancellation and ensures that the barrel (12) remains stable during firing. This solves the problem of the angle of departure and contributes to a high accuracy of shooting.

34 Claims, 9 Drawing Sheets

FIREARM APPARATUS AND METHOD

CROSS-REFERENCE TO RELATED APPLICATIONS

This application claims the benefit of the filing of U.S. Provisional Patent Application Ser. No. 60/677,382, filed by these inventors on May 3, 2005, and the specification thereof is incorporated herein by reference. This application is related to pending U.S. patent application Ser. No. 11/001,450, filed Nov. 30, 2004, the disclosure of which also is incorporated herein.

BACKGROUND OF THE INVENTION

1. Field of the Invention (Technical Field)

The present invention relates generally to cannons and firearms, more particularly to a method of firing projectiles there from, and an apparatus that realizes the method.

2. Background Art

Nearly all firearms used today are engineered according to the basic design solutions developed decades ago. Major small arms developers' product lines are based on such generic-design firearms manufactured only with some cosmetic modifications or minor structural changes most of which do not make any significant improvements to the firearm's core functional features. An example of such a generic design developed nearly a century ago is the Colt Model 1911 pistol, which has also been used as a template for a number of other commercial models. As a result, today's firearms have inherited such functional weaknesses as poor accuracy of shooting due to large projectile dispersion (often as a result of a trade-off for reliability), significant recoil, especially when used with high-energy ammunition, and complicated design.

Most presently used small arms feature a barrel with a cartridge chamber and a breech block, which closes or locks the chamber to prevent gas escape therefrom during firing. In designs with the barrel immovably affixed to the firearm's frame, a reaction force created due to propelling a projectile along the barrel bore acts backward upon the breech block and rotates the firearm around its center of mass. This produces a significant angle between the axis line of the barrel bore immediately prior to firing and at the moment the projectile leaves the muzzle, referred to as the angle of departure, which is a major contributing factor to projectile dispersion and hence inaccuracy of shooting.

In firearms with a movable barrel, the reaction force moves the breech block, interlocked with the barrel, backward during firing. This design introduces yet another factor contributing to large projectile dispersion—tolerance levels between the barrel and the frame. Since tolerances of moving parts are usually in an inverse relationship with product's reliability and its cost to manufacture, most modern firearms' reliability comes at the expense of their accuracy.

The concept of a movable chamber (also referred to as the floating chamber) introduced at the beginning of the $20^{th}$ century suggested some usage of the reaction force, an example of which was disclosed by David Williams in U.S. Pat. No. 2,090,657 where a small-caliber ammunition's energy is distributed to propel a projectile and move a heavy breech block with a movable chamber. Although the movable-chamber concept suggested superior accuracy firearm designs due to the opportunity to controllably use the reaction force to move the chamber and keep the barrel undisturbed and stable during firing, such firearms showed little or no improvement in projectile dispersion. The problem of unsatisfactory dispersion stems from the following: Upon firing a cartridge, the reaction force moves the chamber with a cartridge case therein backward exposing the breech end of the barrel to the high-pressure gas from the deflagrating propellant. Since the gas-pressure force acting upon the breech end of the barrel is uncompensated, it displaces the barrel forward and around the firearm's center of mass producing a tangible angle of departure and resulting in projectile dispersion proportional to the ammunition energy, its caliber, friction of the projectile against the wall of the barrel bore, and the area of the breech end of the barrel. Prior art designs show no evidence of any successful solutions to this problem. Against the foregoing background, the present invention was developed.

SUMMARY OF THE INVENTION (DISCLOSURE OF THE INVENTION)

The present invention provides an apparatus and a method of firing arms. This disclosure will often refer to "firearms", but it is to be understood that the invention has utility in arms of all types, not just small arms to be carried on the person, but including armaments, cannon and other heavy arms. The term "firearm" is to be understood as an assembly that includes a barrel from which a projectile is propelled by means of gas pressure developed either through a deflagration of propellant or other means that make use of gas pressure differential to propel the projectile. Thus it is intended to include any type of arms to which the above definition is applicable.

The present invention addresses the problem of minimizing the angle of departure in firearms and offers solutions applicable to most small and large barreled arms. Most embodiments shown feature a barrel immovably fixed in the firearm's frame, a movable chamber or cartridge container, and a stand formed as a portion of the frame and having a pressure surface. Stabilization of the firearm during firing is achieved by making the net forces generated by gas pressure apply in opposite directions and be substantially equal in magnitude, thus minimizing any displacement of the firearm during firing and achieving very high accuracy of shooting.

The proposed firearm designs are simple, reliable, and inexpensive to manufacture. This invention also permits the usage of high power ammunition with the above mentioned advantageous features unaffected. This makes such firearms excellent weaponry for the armed forces, law enforcement, and other professional services. Some of the main objects and advantages of the present invention are minimal projectile dispersion independent of ammunition energy, excellent mass distribution, reparability and interchangeability of parts, and practical applicability to many types of barreled arms.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating preferred embodiments of the invention and are not to be construed as limiting the invention. In the drawings.

Reference Numerals In Drawings

| | | | |
|---|---|---|---|
| 10 | Frame | 11 | Frame frontal wall |
| 12 | Barrel | 14 | Pin |
| 16 | Cartridge container | 18 | Countermass main body |
| 20 | Cartridge container stop | 22 | Muzzle end |
| 24 | Breech end | 26 | Cartridge case |
| 28 | Projectile | 30 | Stand |
| 32 | Stand pressure surface | 34 | Barrel bore |
| 36 | Cartridge container working surface | 38 | Countermass back surface |
| 40 | Breech end surface | 42 | Aperture |
| 44 | Stand recess | 46 | Hollow bore |
| 48 | Side projection | 50 | Loader |
| 52 | Loader return spring | 54 | Countermass return spring |
| 55 | Container return spring | 56 | First counteractor stop |
| 58 | Hammer | 60 | Firing pin |
| 62 | Rest | 181 | First counteractor |
| 182 | Second counteractor | 321 | Front subchamber |
| 322 | Rear subchamber | 323 | Annulus washer |

DESCRIPTION OF THE PREFERRED EMBODIMENTS

Best Modes for Carrying Out the Invention

FIGS. 1, 2, 3, 4, 5, 6, 7, 8, 9, 10, and 11—Preferred Embodiment In this description, references are made to different states of a firearm. A firearm is said to be in battery position when it is loaded and ready for firing.

Unless stated otherwise, the direction of movements should be understood as follows: "forward" refers to substantially the same direction as the direction of projectile movement. Likewise, "backward" refers to a direction substantially opposite the direction of projectile movement. Similarly, relative position of parts is defined as follows: "front" generally means toward the muzzle of the firearm, and "back" means away from the muzzle of the firearm, where the term "muzzle" refers to the end of the barrel from which a bullet or projectile emerges in firing. The terms "axial" and "longitudinal" are used interchangeably.

Figure 1:
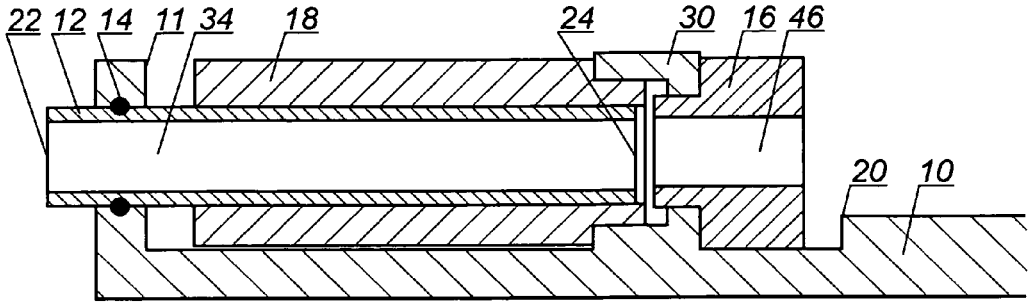
FIG. 1 is a schematic, partial, side sectional view of a partial side view shown of a single-shot (i.e. non-automatic) apparatus constructed according to the present disclosure. The figure shows the parts of the apparatus in "battery position" before firing a cartridge (cartridge not shown to improve clarity).
Figure 2:
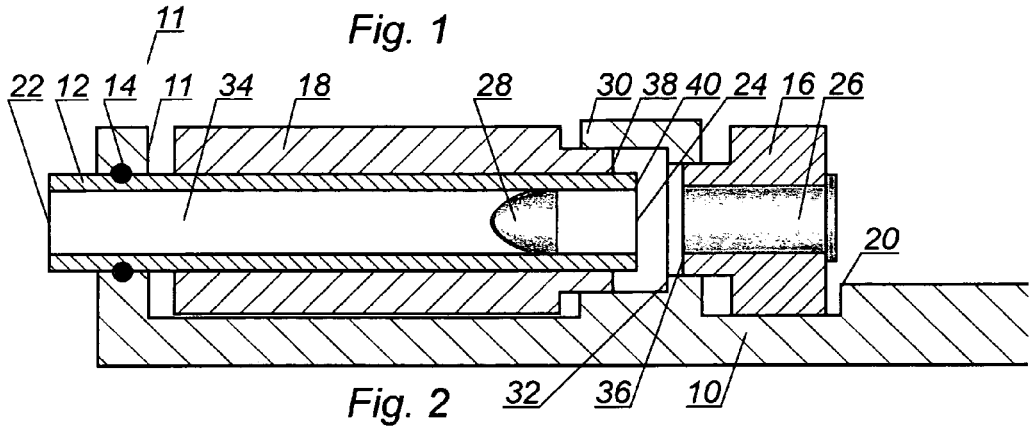
FIG. 2 is a schematic drawing similar to FIG. 1, showing the arrangement of parts during firing.
Figure 3:
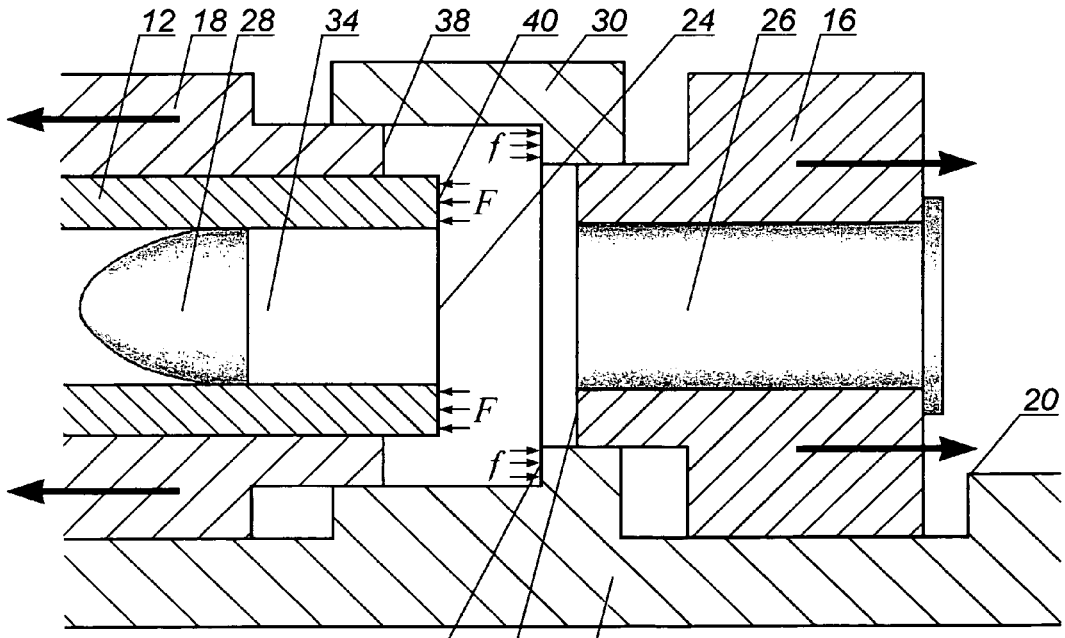
FIG. 3 is an enlarged side sectional view of a portion of the apparatus depicted in FIG. 2.

FIGS. 1 through 3 illustrate, by way of introductory summary, some of the main aspects of the present invention. FIG. 1 shows a firearm before firing (a cartridge is not depicted to show the firearm's internal structure). FIGS. 2 and 3 show the firearm during firing. Countermass main body 18 and cartridge container 16 are parts of the firearm capable of movement substantially in the axial directions (forward and backward, respectively). Upon firing a cartridge, gas from a burning cartridge propellant expands within the firing chamber, producing pressure that acts upon all surfaces exposed to the gas. The resulting forces move those parts or items which are movable in relation to the firearm's frame 10: projectile 28 moves forward along barrel bore 34, countermass main body 18 also moves forward, and cartridge container 16 with cartridge case 26 therein moves backward, as suggested by the directional arrows in FIG. 3.

FIG. 3 illustrates that gas pressure in the firing chamber produces a force F that acts upon breech end surface 40 of the barrel 12, acting to push the barrel 12 (and thus the entire firearm) forward, thereby tending to displace the barrel axis "off the target" during firing. To prevent this displacement, according to the invention a stand pressure surface 32 is formed in the stand member 30. As seen in FIG. 3, gas pressure in the firing chamber produces a force f that acts upon stand pressure surface 32. Force f pushes backwardly on stand 30 (and thus on the entire firearm) during firing. These forces F and f act in opposition directions upon parts of the apparatus that are immovable with respect to frame 10, as suggested by the directional arrow triplets in FIG. 3. As a result of the mutual cancellation of oppositely directed forces, barrel 12 remains stable and does not undergo any substantial "off target" displacement during firing. This minimizes the firearm's angle of departure, and thus contributes to a high accuracy of shooting.

In the preferred embodiment of this disclosure, the cartridge case 26 during firing is disposed at least partially within a hollow bore 46 of a movable cartridge container 26. During firing, the hollow bore 46 is secured against gas escape solely by the cartridge case 26, rather than a part of the firearm (i.e. breech block or equivalent) as typically encountered with prior art firearms. It is noted that the presently disclosed method of barrel stabilization by mutual cancellation of oppositely directed forces can as well be practiced with a breech block type apparatus, producing similar results. Followed below is a detailed description of the structure and operation of the invention.

Figures 4, 5, 6:
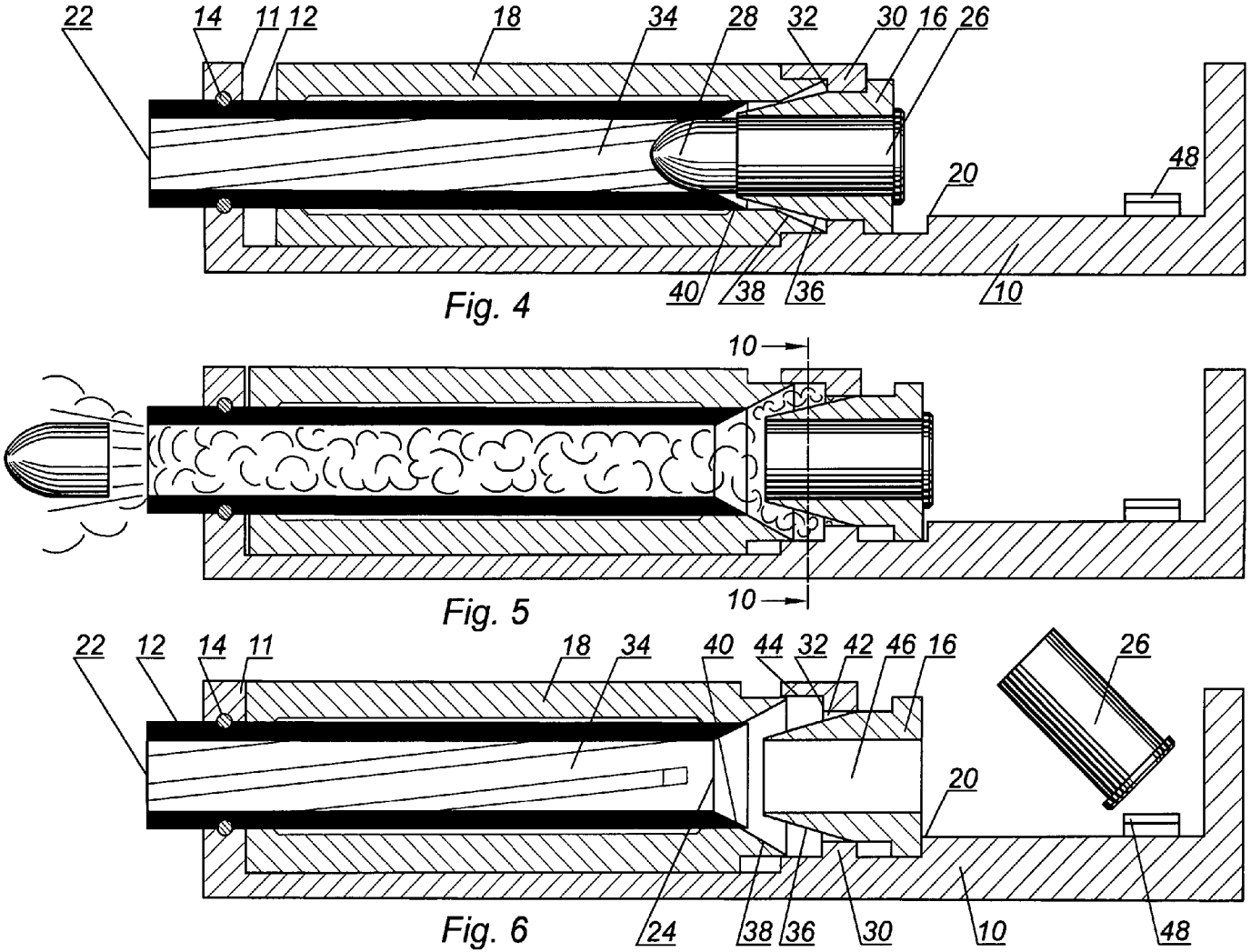
FIG. 4 is a schematic drawing of a partial side sectional view of a single-shot (i.e. non-automatic) firearm constructed according to the present disclosure. The figure shows the arrangement of parts of an apparatus before the firing of a cartridge.
FIG. 5 is a schematic drawing similar to FIG. 4, showing the arrangement of parts of an apparatus according to this disclosure, after the projectile has exited the muzzle but before gas pressure in the barrel bore has dropped to a level safe for cartridge case extraction.
FIG. 6 is a schematic drawing similar to FIG. 5, showing the arrangement of parts of an apparatus according to the disclosure, after the projectile has left the muzzle and gas pressure in the barrel bore has dropped to a level safe for cartridge case extraction.
Figures 7, 8, 9:
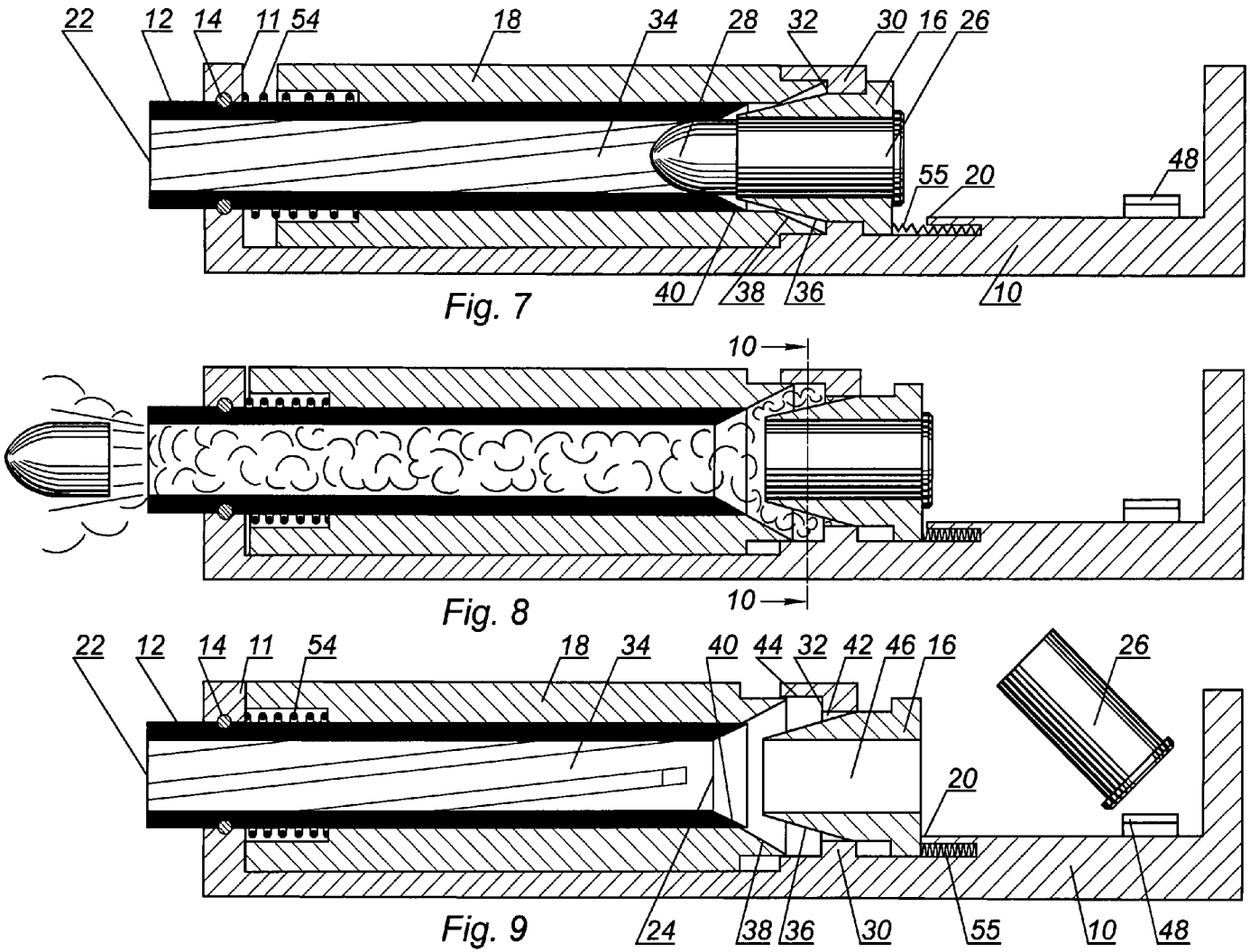
FIG. 7 is a schematic drawing of a partial side sectional view of a single-shot firearm apparatus constructed according to the present disclosure and featuring return springs for the countermass main body and the cartridge container. The schematic shows the arrangement of parts of an apparatus according to the present disclosure before firing of a cartridge.
FIG. 8 is a schematic drawing similar to FIG. 7, showing the arrangement of parts of an apparatus according to the invention, after the projectile has exited the muzzle, but before gas pressure in the barrel bore has dropped to a level safe for cartridge case extraction.
FIG. 9 is a schematic drawing similar to FIG. 8, showing the arrangement of parts of an apparatus according to the disclosure, after the projectile has left the muzzle and gas pressure in the barrel bore has dropped to a level safe for cartridge case extraction.

FIGS. 1 through 11 show the preferred embodiment of the main part of the firearm apparatus. Positions of different parts of the firearm before firing (that is, in battery position) are shown in FIGS. 1, 4, and 7. Positions of parts after the projectile 28 has exited the muzzle 22 are presented in FIGS. 5, 6, 8 and 9. The firearm apparatus comprises the following main parts: base or frame 10, barrel 12 immovably affixed to frame 10 (as with pins 14 or other immobilizing means), the barrel having an axis (according to known convention) and barrel bore 34, muzzle end 22 and breech end 24. The firearm apparatus also includes an inert mass to be further described. The surface of the barrel 12, formed at the breech end 24 that has a non-zero projection onto a plane perpendicular to the axis line of barrel bore 34, is referred to as the breech end surface 40. Barrel 12 may have more than one location along its length where it is affixed to frame 10.

Frame 10 is an element or a set of elements that is used to mount and support some or all parts of the firearm. Some elements or parts of the firearm may be made as integral parts of frame 10. "Inert mass" is a collective term. It consists of two or more parts, where at least two parts of the firearm comprising the inert mass preferably move in substantially opposite directions during firing. The term "during firing" refers to the time interval commencing with the moment the propellant is ignited, and ending at the moment the projectile has exited muzzle end 22. Likewise, the term "process of firing" refers to the processes that occur during firing.

The inert mass is defined as all parts that move during firing using the energy from the high-pressure gas. These parts do not necessarily have to be parts of the firearm only. Parts of the cartridge may also constitute parts of the inert mass. Different members of the inert mass may move in different directions and have any type of movement (e.g. straight-line movement, rotation, or other). In FIGS. 1 through 6, the inert mass includes the following members: cartridge container 16 with cartridge case 26 disposed at least partially therein during firing, countermass main body 18, projectile 28, and the cartridge propellant (not shown in the drawings). In FIGS. 7 through 9, the inert mass also comprises countermass return spring 54 and container return spring 55. Cartridge container 16 is to receive a cartridge to be fired or discharged, FIGS. 4 and 7. Cartridge case 26 of the cartridge is fully or partially disposed in a hollow bore 46 of cartridge container 16. A bullet or projectile 28 may either be physically attached to cartridge case 26, or be separate from cartridge case 26. In FIGS. 4 and 7, projectile 28 is partially inserted into the mouth of cartridge case 26 and partially in barrel bore 34. The mouth of a cartridge case is understood here as the open end of the cartridge case, from which the projectile is expelled in firing. In general, the positioning of projectile 28 with respect to barrel bore 34 before firing may vary: projectile 28 may be not inserted into barrel bore 34 at all, it may be partially inserted, or it may be fully inserted into barrel bore 34.

Stand 30 is formed in frame 10 or immovably attached to it. Stand 30 has an opening or aperture 42 which generally serves as a guide for the reciprocating movement of cartridge container 16. Stand 30 also has stand recess 44, into which the back end of countermass main body 18 (i.e. the end closest to stand 30) is inserted, generally as a male-to-female type of connector. Countermass main body 18 is capable of reciprocating motion substantially along the barrel's longitudinal axis. The depth of the insertion of the back end of countermass main body 18 into stand recess 44 preferably, but not necessarily, equals or exceeds the range of movement of countermass main body 18.

Cartridge container 16 is disposed in aperture 42 for a reciprocating motion, as seen in FIGS. 4 through 9. When the firearm is in the battery position (FIGS. 4 and 7), cartridge container 16 is situated proximal to barrel 12. Cartridge container 16 is capable of moving backward, i.e. in the direction distal from barrel 12, and this movement is limited by a cartridge container stop 20 either formed in frame 10 or made as a separate element and affixed to frame 10. The cartridge container stop 20 is between the cartridge container 16 and the back wall of the frame, and stops backward movement of the cartridge container. Backward movement of the container 16 is stopped before the loader 50 contacts and is stopped by the back wall means. This difference in stopping times/places thereby separates the loader 50 from the container 16 while they are traveling backward. Thus, the range of movement of cartridge container 16 is limited between the front position, where it is proximal to barrel 12 (FIGS. 4 and 7), and the back position, where it is distal from barrel 12 (FIGS. 6 and 9).

Countermass main body 18 is preferably (although not necessarily) disposed at least partially around barrel 12 for a reciprocating motion. When the firearm is in the battery position, the back end of countermass main body 18 is inserted into stand recess 44. During the firearm operation, countermass main body 18 is capable of moving forward, i.e. toward muzzle end 22, whereby the back end of countermass main body 18 shifts at least partially out of stand recess 44. Countermass main body 18 can move forward until it comes in contact with frame frontal wall 11, at which moment countermass main body 18 ceases its movement. Thus, the range of movement of countermass main body 18 is limited between the back position, where its back end is inserted into stand recess 44 (FIGS. 4 and 7), and the front position, where it contacts frame frontal wall 11 (FIGS. 6 and 9).

The firearm apparatus features an expandable firing chamber defined at least in part by the following surfaces (some of these surfaces may become parts of the chamber at different times during firing): stand pressure surface 32, cartridge container working surface 36, the inner surface of cartridge case 26 (i.e. the inner side wall and the inner bottom portion opposite the open end of the cartridge case), countermass back surface 38, breech end surface 40, the back portion of projectile 28, preferably at least a portion of the wall of stand recess 44, preferably at least a portion of the wall of aperture 42, and the portion of the wall of barrel bore 34 between breech end 24 and the back portion of projectile 28 after projectile 28 has fully entered barrel bore 34. Many of the surfaces of the expandable chamber are evident by observing FIGS. 5 and 8, which show the firearm apparatus at an instant when the parts movable during firing are in motion and projectile 28 has just exited muzzle end 22. After projectile 28 has exited muzzle end 22, the expandable chamber is considered limited on the muzzle end side by a plane positioned at muzzle end 22 and preferably perpendicular to the axis line of barrel bore 34.

Thus, the chamber is defined in part by the breech end surface 40, the working surface 36, and the stand pressure surface 32, so that during firing of the ammunition, gases expand in the firing chamber to move the projectile 28 forward to exit the muzzle end. Simultaneously, the cartridge case 26 and cartridge container 16 move axially together backward in the direction substantially opposite the direction the projectile moves, while gas pressure in the chamber applies oppositely directed net axial forces (that is, all longitudinal forces attributable to the expanding gas resolved into forward and backwardly directed vectors) upon the apparatus and the projectile. (In embodiments using a cartridge case, the net axial force backward acts upon the case as well.)

Figure 10:
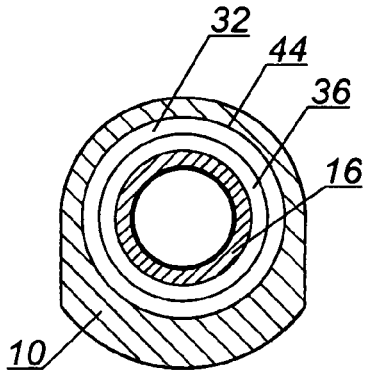
FIG. 10 is a cross-sectional view of the apparatus, taken in the direction of arrows 10-10 in FIG. 5 and FIG. 8.

As suggested by the figures, including FIG. 10, many of the working surfaces of the apparatus, upon which pressure forces act, preferably are annular and coaxial with the barrel axis. Stand pressure surface 32 preferably is annular, that is a continuous ring or annulus, or instead may be a segmented in spaced arcs. Further, as mentioned later herein, the stand pressure surface 32 may be defined within an imaginary plane normal to the barrel axis (FIGS. 1-3, 14, 15). Alternatively, the stand pressure surface 32 may be slanted at some angle in relation to the barrel axis, so that the stand pressure surface is defined within an imaginary cone (e.g., FIGS. 4-9). Similarly, the breech end surface 40 preferably but not necessarily is annular, and may be defined within an imaginary plane normal to the barrel axis. Or, and as seen in FIGS. 4-9), the breech end surface 40 may be slanted at a breech surface angle (perhaps an angle supplementary to the stand pressure surface angle) in relation to the axis, so that the breech end surface 40 is defined within an imaginary cone.

If the ammunition used is of the type in which projectile 28 is attached to cartridge case 26 before firing as depicted in FIGS. 4 and 7, then upon ignition and deflagration of the propellant, high gas pressure developed in cartridge case 26 pushes projectile 28 and detaches it from cartridge case 26 thereby filling the available space with gas. Thus, we refer to this moment as the time of formation of the expandable chamber. The surfaces exposed to the gas, at least some of which are listed above in the definition of the expandable chamber, start being acted upon by the increasing gas pressure. As a consequence, the elements movable with respect to frame 10 begin to move, exposing some other surfaces to the gas. There are at least two such surfaces: the wall of stand recess 44 and the wall of aperture 42, which become gradually exposed as the corresponding parts—countermass main body 18 and cartridge container 16, respectively—continue moving axially in their respective forward and backward directions. When projectile 28 has fully entered barrel bore 34, the portion of the wall of barrel bore 34 between breech end 24 and the back of projectile 28 also become exposed to the gas. The expandable chamber expands as projectile 28 proceeds forward along barrel bore 34, and countermass main body 18 and cartridge container 16 with cartridge case 26 therein move in the forward and backward directions, respectively. Thus, the anatomy of the expandable chamber is best understood when considered in terms of these time-linked events.

Figure 11:
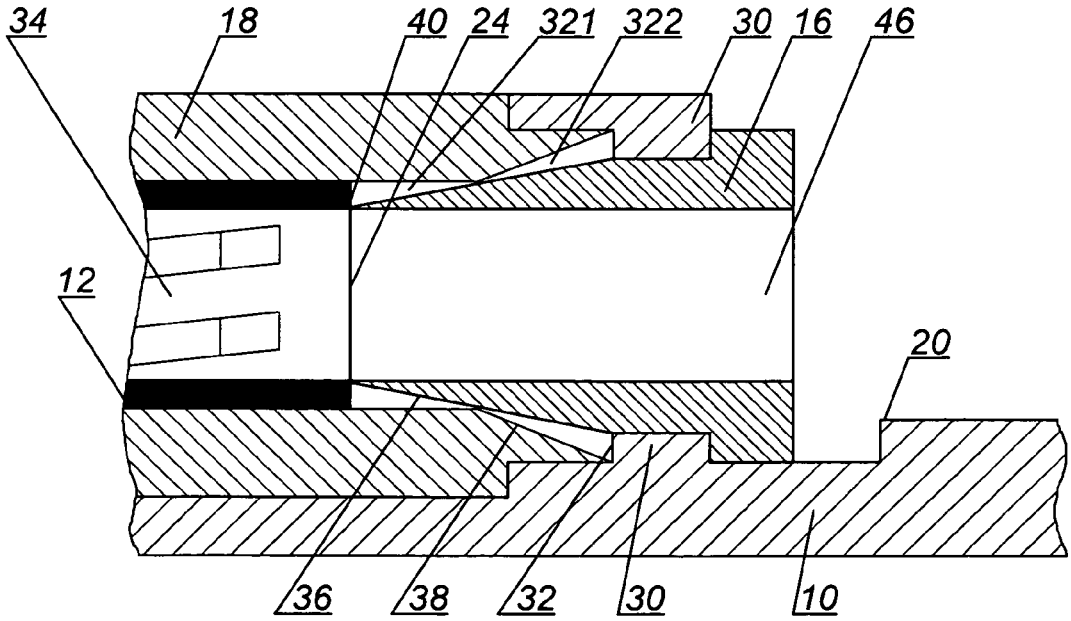
FIG. 11 is a schematic drawing of a partial side view, shown enlarged and in section, of an apparatus of the disclosure, prior to firing ammunition.

An enlarged portion of a firearm apparatus similar to that shown in FIGS. 4 through 10 is shown in FIG. 11. The functionality of this embodiment is substantially similar to the one shown in FIGS. 4 through 10. A structural difference is that breech end surface 40 is not slanted, but has a right-angle cut. It should be noted that any or all slanted surfaces of the firearm depicted in FIGS. 4 through 9 (i.e. cartridge container working surface 36, countermass back surface 38, and breech end surface 40) alternatively may have a right-angle cut (that is to lie or be defined within an imaginary plane normal to the barrel bore axis, as discussed previously above and as seen in FIGS. 1-3) with little or no change in the firearm's functionality. The enlarged portion of the firearm in FIG. 11 is provided here to show that the expandable chamber may be considered as having two (or more) subchambers depending on the configuration of the elements that form the expandable chamber. It is seen in FIG. 11 that the relative position of countermass main body 18 and cartridge container 16 as well as the difference in angles of countermass back surface 38 and cartridge container working surface 36 divide the expandable chamber into two communicating subchambers—front subchamber 321 and rear subchamber 322.

During firing of the embodiment of FIG. 11, gas from deflagrating propellant enters front subchamber 321 first and flows into rear subchamber 322 via a communicating passage formed by the angled part of countermass main body 18 and cartridge container working surface 16. The rate of the flow depends on the pressure differential in the two subchambers and the size of the communicating passage. The communicating passage increases in size as the respective parts forming it—countermass main body 18 and cartridge container 16—move in their respective directions (the speed of movement of the moving parts will in turn depend at least partially on the parts' weights and their surface areas exposed to the gas). Thus, it is seen that in the two subchambers, pressure as a function of time develops at different rates: before gas pressure equilibrium is reached in the two subchambers, gas pressure in front subchamber 321 has a higher value than that in rear subchamber 322. This means that parts immovable with respect to the firearm's frame 10 and exposed to the gas in the two subchambers receive different gas pressure values before gas pressure equilibrium is reached: it can be seen in FIG. 11 that breech end surface 40 in front subchamber 321 is exposed to a higher gas pressure value than stand pressure surface 32 in rear subchamber 322.

Since it is desirable to avoid any substantial firearm displacement during firing, oppositely directed forces from gas pressure acting upon parts immovable with respect to the frame should be equalized as much as possible. In this case, the forces acting upon breech end surface 40 should be made equal in magnitude to the oppositely directed forces acting upon stand pressure surface 32. Since gas pressure acting upon breech end surface 40 is higher than that acting upon stand pressure surface 32 at least during some period of time, the respective forces can be equalized by making the respective areas inversely proportional to the gas pressure values to which the areas are exposed. More specifically, for the design shown in FIG. 11, the area of stand pressure surface 32 should be made larger than the area of breech end surface 40. This will assure that a lower gas pressure in rear subchamber 322 acting upon stand pressure surface 32 creates a force substantially equal in magnitude to the oppositely directed force created by a higher gas pressure in front subchamber 321 and acting upon breech end surface 40. Thus, it is seen that the shape, surface area, weight, and relative position of parts in the firearm may affect its functionality and, therefore, should be chosen accordingly to achieve a desired effect.

Side projection 48 (FIGS. 4 through 9) is an optional part of the apparatus, integrally formed in frame 10 or affixed to frame 10. Configured to promote expulsion of spent cartridges from the apparatus, it is located anywhere in the back part of the firearm on the way of cartridge case 26 when the latter exits hollow bore 46. Side projection 48 also is situated at a distance that preferably exceeds the length of cartridge case 26 from the back of cartridge container 16 in its rearmost position, as best seen in FIGS. 6 and 9. Side projection 48 is to deflect cartridge case 26 and change direction of movement after cartridge case 26 has exited hollow bore 46.

Operation of the Preferred Embodiment—FIGS. 1, 2, 3, 4, 5, 6, 7, 8, 9, 10, and 11

FIGS. 4 and 7 show the arrangement of parts and the placement of a cartridge in the firearm ready for firing. Ignition of the cartridge propellant is performed in any way known in the art. It can be, for example, electrical ignition, mechanical ignition by a firing pin, laser-actuated ignition, or performed by any other means that will initiate deflagration of the cartridge propellant. A specific implementation will also depend on the type of firearm used. Because there are many possible ways to execute the operation, and to avoid distracting from the main aspects of the process of firing, no specific propellant igniting means (fuses, firing pins, or the like) are shown in FIGS. 1 through 11.

Upon the ignition, rapidly deflagrating propellant produces a large amount of gas which, in turn, creates high pressure and causes projectile 28 to move. Projectile 28 detaches from cartridge case 26 and, if it is not already fully or partially inserted in barrel bore 34, enters barrel bore 34 via breech end 24. Rapidly expanding gas from the deflagrating propellant fills the expandable chamber defined above. The gas pressure that develops in the chamber causes projectile 28 to move along barrel bore 34 and at the same time acts upon countermass back surface 38 causing countermass main body 18 to move forward, and upon cartridge container working surface 36 causing cartridge container 16 to move backward.

The gas pressure also acts upon the inner surface of cartridge case 26 causing cartridge case 26 to expand. The wall of cartridge case 26 is firmly pressed against the wall of hollow bore 46. With the cartridge case thus firmly pressed against the wall of the hollow bore, there is a temporary frictional engagement between the cartridge case 26 and the cartridge container 16, for the duration, at least, of the cartridge's expansion. Additionally, the gas pressure acting upon cartridge container working surface 36 and the bottom of cartridge case 26 produces forces proportional to the areas of those respective surfaces. Consequently, cartridge container 16 and cartridge case 26 attain accelerations proportional to the forces acting thereupon and inversely proportional to their respective weights. In other words, cartridge container 16 and cartridge case 26 co-accelerate in the same direction and therefore tend to move at a slower rate relative to each other than with respect to frame 10. Thus, a combination of these physical phenomena—expansion of cartridge case 26 against the wall of hollow bore 46 and co-acceleration of cartridge container 16 and cartridge case 26—ensures that cartridge case 26 substantially seals hollow bore 46 during firing. The expression "cartridge case 26 substantially seals hollow bore 46" is to be understood as referring to the process in which cartridge case 26 secures hollow bore 46 against any substantial gas escape and retains this function throughout the duration of firing, without the necessity to use any additional parts, such as a breech block or an equivalent thereof typically used in prior art designs.

It is noted that cartridge case 26 may, but not necessarily, be arranged to move a predetermined distance backward in hollow bore 46 relative to cartridge container 16 during firing. This distance is arranged accordingly so that a substantial portion of cartridge case 26 remains in hollow bore 46. Cartridge case 26 exits completely out of hollow bore 46 after projectile 28 has exited muzzle end 22.

Thus, a number of parameters are taken into account to ensure that cartridge case 26 performs sealing of hollow bore 46 as defined above. The type of alloy from which cartridge case 26 is made, the thickness of its wall, the surface area of cartridge case 26, and the gas pressure developed through a deflagration of the cartridge propellant will in part determine the expansion of cartridge case 26 and the friction between its wall and hollow bore 46. Likewise, the calculated accelerations of cartridge container 16 and cartridge case 26 will in part depend on the gas pressure developed in the chamber, the surface areas of cartridge container working surface 36 and the bottom of cartridge case 26, and the weights of the moving parts. Thus, cartridge container 16 and cartridge case 26 move together in the direction substantially opposite the direction of the projectile movement during firing. For convenience of reference, we will refer to a part or a set of parts that move, using the energy from the high-pressure gas from propellant deflagration, in a direction substantially opposite the direction of projectile movement during firing an "active mass." It is important to note that such parts do not have to be parts of the firearm. This applies, for example, to cartridge case 26, which does not constitute a part of the firearm, yet it forms a part of the active mass. Hence, in this embodiment the active mass includes cartridge container 16 and cartridge case 26.

As seen from the foregoing description, some elements of the firearm, which either form part of the firearm's frame 10 or are mounted immovably with respect to the frame, have surfaces that define portions of the expandable chamber. These surfaces are too, as expected, acted upon by the gas pressure developed in the chamber. The respective forces that result therefrom have magnitudes proportional to the area of the surface upon which the gas pressure acts and directions normal to the surface.

The forces that act upon parts of the firearm immovable with relation to the frame will tend to displace the firearm during firing unless these forces are cancelled out. There are two parts immovable in relation to frame 10, portions of which define portions of the expandable chamber. These parts are barrel 12 and stand 30, both having a number of surfaces of various configurations. Gas pressure in the chamber produces forces that act upon these surfaces. The forces can be represented by vectors with non-zero radial, longitudinal, or both—radial and longitudinal—components. From the cross section shown in FIG. 10, it is understood that the expandable chamber is radially symmetric. The radial components of the forces developed in the chamber will substantially cancel one another out. In general, the cross-section of the expandable chamber does not have to be annular, or even radially symmetric, to satisfy the condition of mutual cancellation of the force components lying in a plane perpendicular to the axis line of the barrel bore.

There are, however, some surfaces which will also have longitudinal force components. These surfaces include stand pressure surface 32 and breech end surface 40. The surface of stand pressure surface 32 and that of breech end surface 40 are used to appropriately distribute gas pressure forces acting axially in opposite directions. This force distribution should make all forces acting longitudinally in one direction substantially equal to all forces acting longitudinally in the opposite direction. This is achieved by making the surface area of stand pressure surface 32 proportional to the area of the normal projection of the surface of breech end surface 40 onto a plane perpendicular to the axis line of the barrel bore. The proportionality coefficient should be chosen accordingly so as to equalize the two oppositely directed net longitudinal forces. It is noted that there will typically be a number of other factors that may have an effect on the choice of a specific value of the proportionality coefficient, such as longitudinal force components acting upon the rear of projectile 28. These force components will normally have non-zero values due to the friction of projectile 28 against the wall of barrel bore 34. Other factors that may influence the choice of the proportionality coefficient include the clearances between moving parts in the expandable chamber, the difference in calibers of the barrel bore and projectile, the shape of the projectile, whether the projectile has a jacket and the material from which the jacket is made, whether the barrel bore has rifling, the depth and width of the rifling grooves, the temperature expansion coefficient of the material the barrel is made from, friction of moving parts against the surfaces they slide on, and the tension coefficient of springs used with moving parts. Therefore, a specific value of the proportionality coefficient should be chosen accordingly to ensure that the oppositely directed longitudinal force components will have substantially equal net magnitudes, resulting in their substantial mutual cancellation during firing. This ensures that the firearm does not undergo any substantial displacement while projectile 28 is moving in barrel bore 34.

Thus, it is seen that in order to achieve firearm stability during firing, the following considerations should be taken into account:

- Oppositely directed net longitudinal forces developed by gas pressure in the expandable chamber should be made equal to substantially cancel out each other. This should be achieved by the appropriate choice of the surface areas of parts immovable with respect to the frame upon which the gas pressure acts;
- The shape and relative position of the parts that form portions of the expandable chamber will define the dynamics of the gas flow in the chamber and will affect the choice of the areas of the surfaces exposed to the gas pressure;
- The centers of mass of the parts moving in opposite directions should preferably, but not necessarily, be located on the axis line of barrel bore 34.

After projectile 28 has exited muzzle end 22, the moving parts of the firearm—cartridge container 16 with cartridge case 26 therein and countermass main body 18—come in contact with cartridge container stop 20 and frame frontal wall 11, respectively, and cease their movements. In this embodiment, it is preferable, although not necessary, to avoid any substantial firearm displacement after projectile 28 has left muzzle end 22. To minimize the firearm displacement due to the impacts of cartridge container 16 and countermass main body 18 against respective parts of the firearm, the following conditions preferably are met:

- Cartridge container 16 and countermass main body 18 should contact cartridge container stop 20 and frame frontal wall 11 at approximately the same time;
- The kinetic energy of all parts moving in one direction should be substantially equal to the kinetic energy of all parts moving in the opposite direction at least at the moment of contacting the respective parts of frame 10;
- The vectors of the net forces applied by the moving parts to frame 10 due to the impacts should be oppositely directed and, preferably, lie on the same line to avoid creating a torque.

The preferred embodiment may also include the step of ejecting cartridge case 26 from hollow bore 46 of cartridge container 16 after projectile 28 has left barrel bore 34. After projectile 28 has exited muzzle end 22, gas pressure in the expandable chamber drops to equilibrium with the ambient gas pressure. The process of the pressure drop in the expandable chamber is a function of time: the gas pressure in the chamber reaches equilibrium with the ambient pressure at some time point when projectile 28 has traveled a certain distance from muzzle end 22. Because the chamber pressure remains high for some period of time after projectile 28 has left muzzle end 22, it is safe to extract cartridge case 26 from hollow bore 46 only when the chamber pressure has dropped to some predetermined level (premature cartridge case extraction may cause cartridge case 26 to expand, break open, or result in some other uncontrollable process). The specific value of this pressure level will depend on several factors, such as the type of ammunition used (its power, the material from which the cartridge case is made, etc.), as well as safety requirements accepted in the industry. FIGS. 5 and 8 show the arrangement of parts at an instant when projectile 28 has just exited muzzle end 22, while the chamber pressure has not yet reached a predetermined level safe for cartridge case extraction, and cartridge container 16 and countermass main body 18 have not yet ceased their movement away from each other.

When the decreasing gas pressure in the chamber reaches the level safe for cartridge case extraction, the wall of cartridge case 26 is no longer pressed hard against the wall of hollow bore 46. When cartridge container 16 contacts cartridge container stop 20 and ceases its movement with respect to frame 10, cartridge case 26 keeps moving in the backward direction by inertia, and is ejected from the container 16. It is seen therefore, that when the container 16 is stopped by the container stop 20, said the cartridge case 26 is ejected from the container by inertia.

Then, when cartridge case 26 ejects completely out of hollow bore 46 (we refer to this as the extraction of the cartridge case), it hits side projection 48 on its way and is discarded (FIGS. 6 and 9), ultimately and preferably to be expelled from the firearm. It should be noted that since cartridge case 26 delivers some energy to frame 10 by hitting side projection 48, it may slightly displace the firearm after firing. This displacement will be minimal when side projection 48 is located as close to the center of mass of the firearm as possible. From a practical standpoint, the displacement of the firearm due to cartridge case 26 will be negligible since the energy delivered by cartridge case 26 to frame 10 is typically two orders of magnitude less then the energy of the other moving parts.

Figure 12:
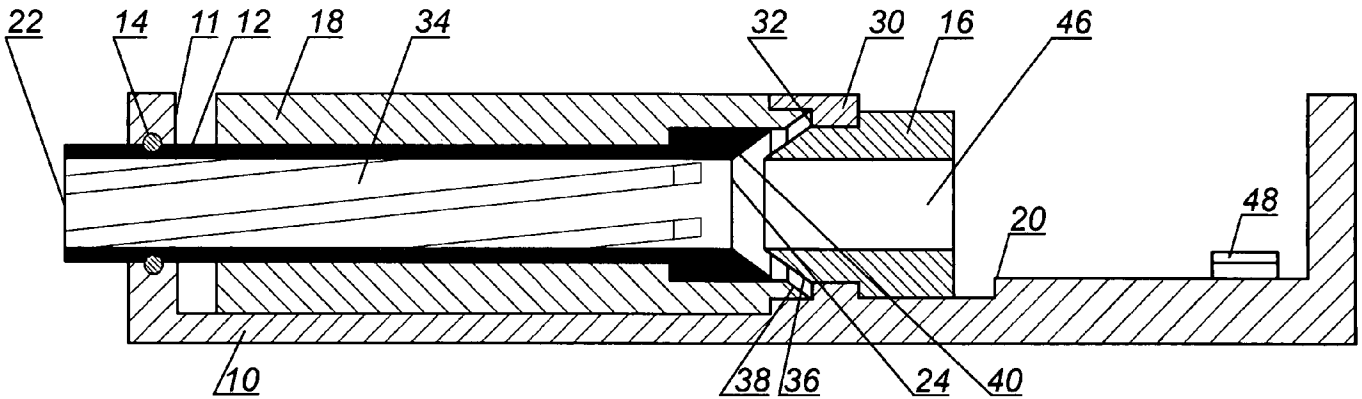
FIG. 12 is a schematic drawing of a partial side sectional view of a firearm according to the present disclosure. The schematic shows a first special-case or alternative embodiment, and the arrangement of parts of the apparatus before firing ammunition.

FIG. 12—First Special-Case Embodiment

A first special-case embodiment shown in FIG. 12 is very similar in design and operation to the preferred embodiment described above and shown in FIGS. 1 through 11, therefore only aspects specific to this embodiment will be discussed here in detail.

The firearm schematically shown in FIG. 12 features parts that partially form the expandable chamber with surfaces slanted at the same angle. In other words, cartridge container working surface 36, countermass back surface 38, and breech end surface 40 have the slanted surfaces defining the same angle with respect to the axis line of barrel bore 34. This structural feature results in the following operational effect: when gas from the deflagrating propellant fills the expandable chamber during firing, all surfaces exposed to the gas are acted upon by gas pressure of substantially the same magnitude. Unlike the design of the expandable chamber shown in FIG. 11, the expandable chamber in the firearm in FIG. 12 does not have communicating subchambers. This means that the surfaces of parts exposed to the gas in the expandable chamber are acted upon by gas pressure of substantially the same magnitude during most part of the process of firing. Apart from this, the functionality of this embodiment is similar to that of the Preferred Embodiment.

Figure 13:
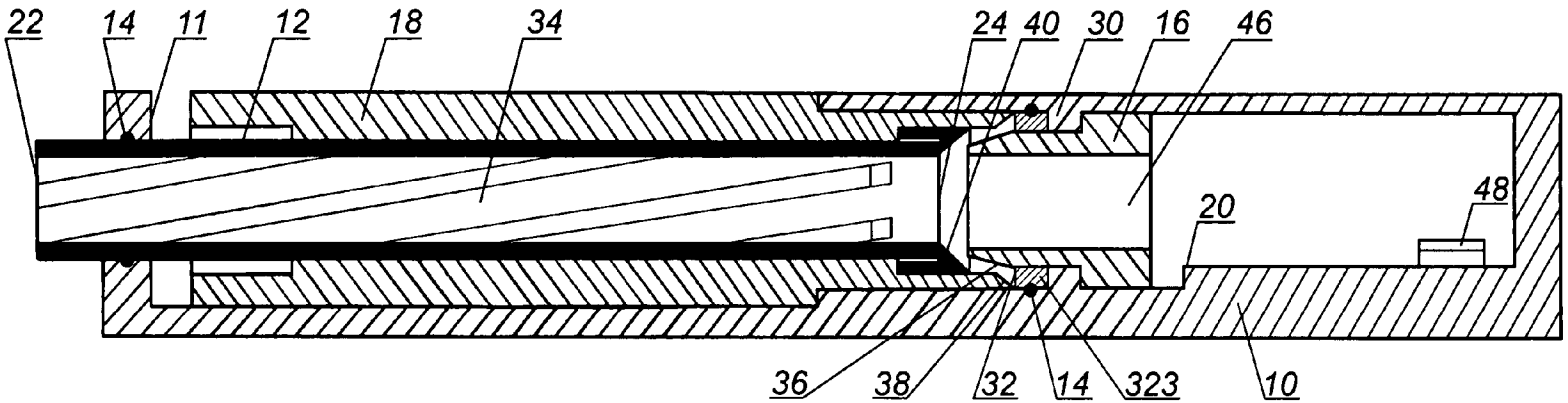
FIG. 13 is a schematic drawing of a partial side view, shown in section, of a firearm apparatus in accordance with this disclosure. The schematic shows a second special-case or alternative embodiment, and the arrangement of parts of the apparatus before firing ammunition.

FIG. 13—Second Special-Case Embodiment

A second special-case embodiment depicted in FIG. 13 is also similar in structure and operation to the Preferred Embodiment shown in FIGS. 1 through 11. Therefore, only distinctive features of this embodiment will be discussed here in detail.

In FIG. 13, breech end surface 40 is a separate part of the firearm that attaches to barrel 12 at its breech end 24 by means of a threaded connection or any other type of connection that will secure breech end surface 40 on barrel 12. This embodiment also features annulus washer 323 immovably fixed in frame 10 with pins or any other type of attachment means and disposed in immediate proximity to the frontal wall of stand 30. Thus, the surface of the frontal wall of annulus washer 323 facing the expandable chamber serves here as stand pressure surface 32. It is noted that in general, annulus washer 323 does not necessarily have to be annular in shape.

Breech end surface 40 and annulus washer 323 as replaceable parts may be used to alter the surface areas of the respective parts immovable with respect to the frame and constituting portions of the expandable chamber. This may have several practical applications. For example, when ammunition having a different energy (i.e. one that develops gas pressure of a different magnitude in the expandable chamber) is to be used, the respective surface areas of the parts immovable with respect to the frame may need to be adjusted accordingly by using replaceable parts. It is also noted that these replaceable parts may have any type of kinematic connection (e.g. via a spring, cam, lever) with the part to which they transfer force or energy.

Figure 14:
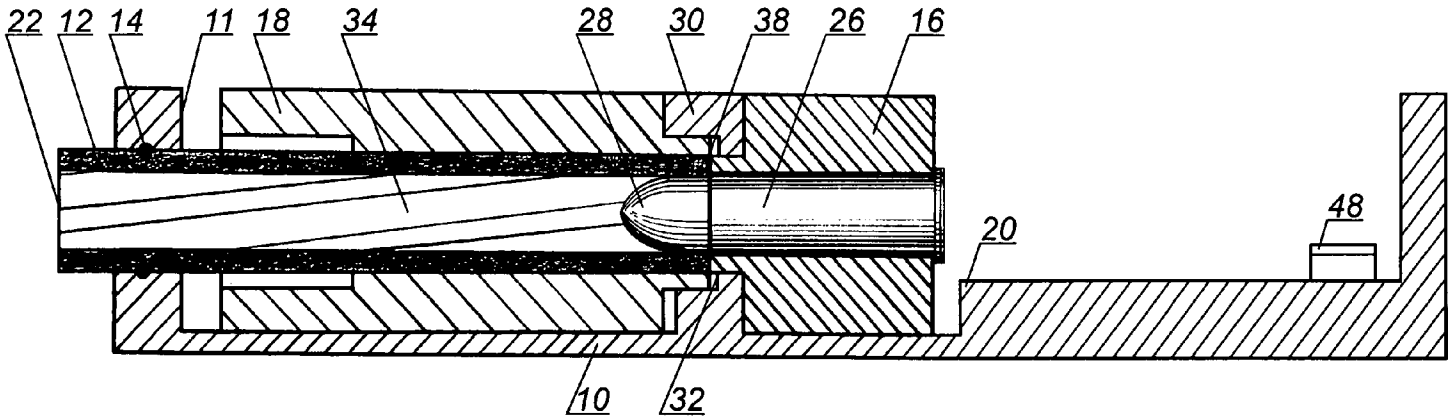
FIG. 14 is a schematic drawing of a partial side view, shown in section, of a third special-case or alternative embodiment of an apparatus according to the present disclosure, shown in a position before firing ammunition.
Figure 15:
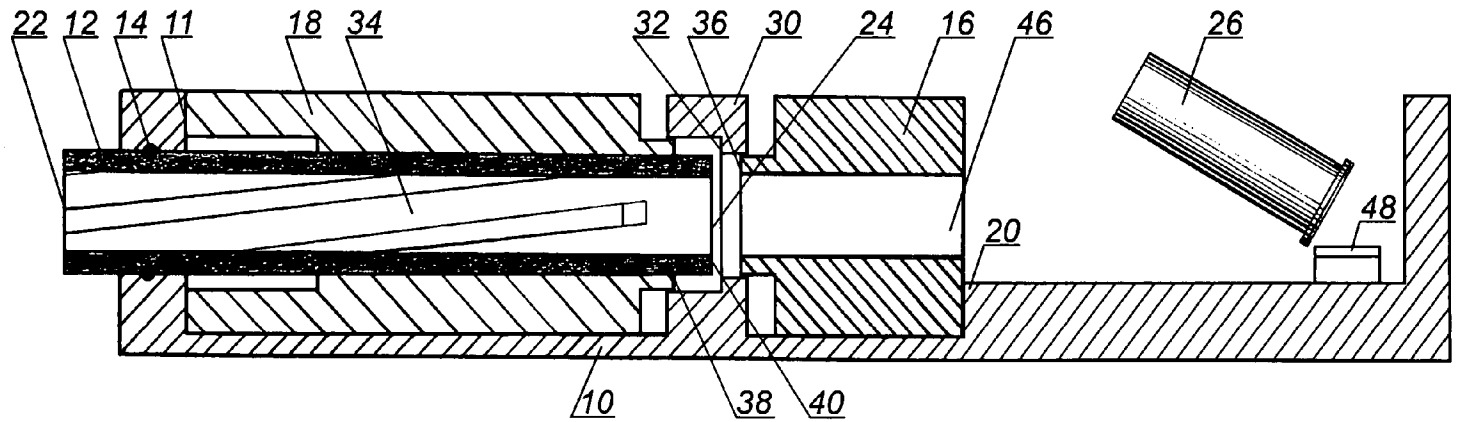
FIG. 15 is a schematic drawing similar to FIG. 14, showing the arrangement of parts of an apparatus according to the third special-case or alternative embodiment of the apparatus, after the projectile has left the muzzle and gas pressure in the barrel bore has dropped to a level safe for cartridge case extraction.

FIGS. 14 and 15—Third Special-Case Embodiment

A third special-case implementation is shown in FIG. 14 where the firearm is in a battery position, and FIG. 15 where the firearm is in a position after the projectile has exited muzzle end 22 and cartridge case 26 has exited hollow bore 46. This embodiment features breech end surface 40, cartridge container working surface 36, and countermass back surface 38 all having surfaces at a right angle with respect to the axis line of barrel bore 34. Thus, in this embodiment the cartridge container working surface 36 is defined within an imaginary plane normal to the barrel bore axis, and the cartridge container working surface contacts a similarly defined breech end surface 40 when the apparatus is in a battery position.

This embodiment also features a specific placement of cartridge container 16 and barrel 12 with respect to each other when the firearm is in the battery position: cartridge container working surface 36 contacts breech end surface 40 forming no gap between the two surfaces prior to firing ammunition. Operationally, such arrangement of parts with no gap between the two surfaces results in the following. Upon ignition of the cartridge propellant, projectile 28, being acted upon by the developing gas pressure in cartridge case 26, starts moving and detaches from the mouth of cartridge case 26 (assuming projectile 28 was attached to cartridge case 26 before firing). Once projectile 28 has detached from cartridge case 26, it starts moving along barrel bore 34, and cartridge container 16 starts moving in a substantially opposite direction forming a gap between cartridge container working surface 36 and breech end surface 40 exposing more surfaces to the gas. Thus, it is seen that in this embodiment, the expandable chamber forms with some surfaces at the early stage of the process of firing, and some other surfaces add in thereafter. The rest of the firearm's operation is similar to the operation of the Preferred Embodiment described above.

FIGS. 16, 17, 18 and 19—Additional Embodiment

The additional embodiment shown in FIGS. 16 through 19 illustrates schematically a firearm apparatus according to the present disclosure and adapted for automatic operation. Automatic operation is understood here as a sequence of operations performed by the firearm to fire a cartridge, eject the cartridge case and load a new cartridge into the firearm. It may or may not include continuous repetition of the sequence of these operations as long as the trigger (or equivalent) is activated and there are cartridges available in the feed system, which is sometimes referred to as "fully automatic" operation in the literature. "Semi-automatic" (also "self-loading" or "auto-loading") operation is often understood in the literature as performing the above sequence of operations once with each trigger pull. Hence, in the present description, the term "automatic operation" should be understood as referring to both—fully automatic and semi-automatic—designs.

This embodiment is similar to the single-shot firearm apparatus described above. It also features some additional components necessary for automatic operation. Therefore, only the parts specific to this embodiment will be described here in full detail.

Figure 16:
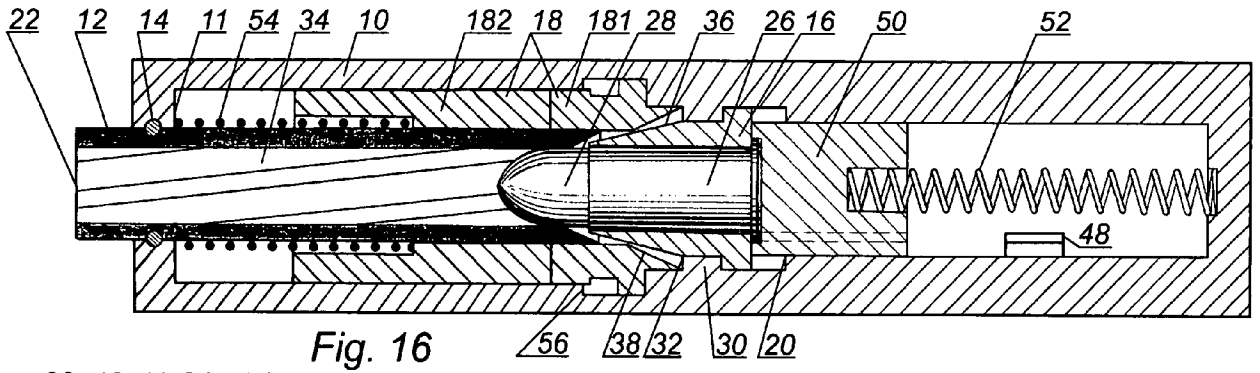
FIG. 16 is a schematic drawing of a partial side view shown in section of a self-reloading (i.e. automatic) firearm constructed according to an additional alternative embodiment of the apparatus. The schematic shows the arrangement of parts of the apparatus before firing ammunition.
Figure 17:
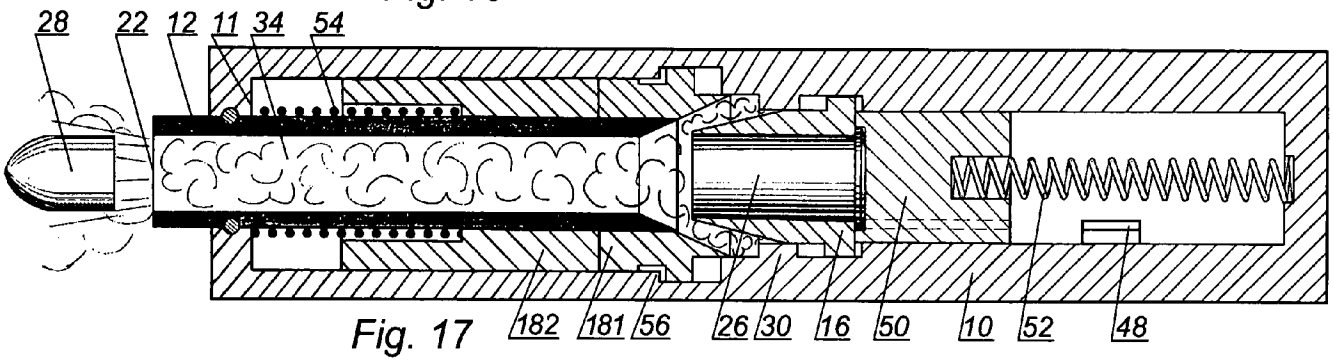
FIG. 17 is a schematic drawing similar to FIG. 16, showing the arrangement of parts of an apparatus according to the additional alternative embodiment, after the projectile has exited the muzzle, but before gas pressure in the barrel bore has dropped to a level safe for cartridge case extraction.
Figure 19:
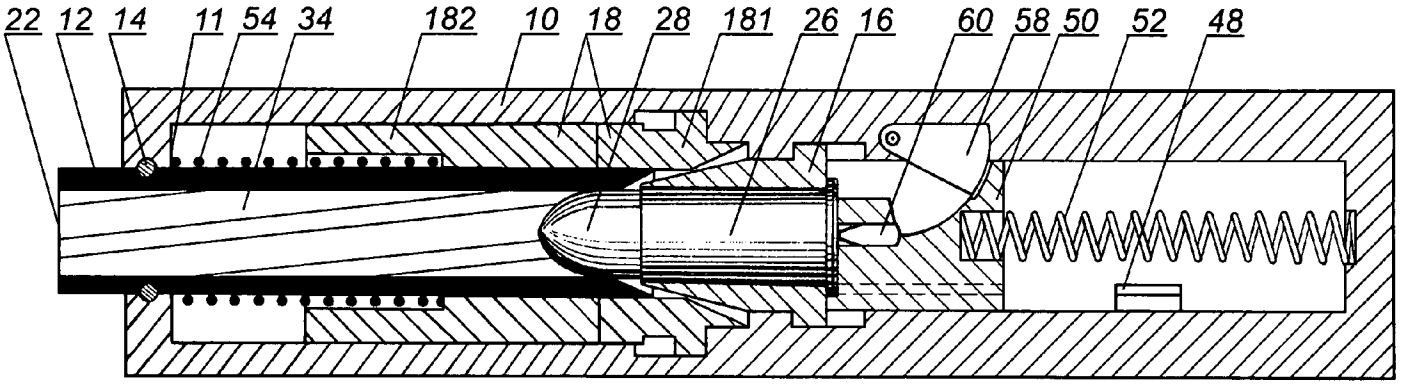
FIG. 19 is a schematic drawing of a partial side view shown in section of a self-reloading (i.e. automatic) firearm constructed according to yet another alternative embodiment of the apparatus according to the present disclosure. The schematic shows the implementation of an apparatus having a hammer and firing pin. The apparatus is depicted in a position ready for firing ammunition.

The automatic firearm apparatus features loader 50 urged toward cartridge container 16 by loader return spring 52. In its front position, loader 50 contacts cartridge container 16, or the rear of cartridge case 26, or both. In FIGS. 16, 17 and 19, it contacts both. Loader 50 preferably is not engaged with cartridge container 16. The main function of loader 50 is to load a cartridge into hollow bore 46 of cartridge container 16. It is noted that loader 50 optionally may serve as a breech block, in which case it additionally contributes to securing hollow bore 46 against substantial gas escape during firing. Loader 50 may also include some or all parts of an ignition initiation mechanism.

The cartridge may be supplied from a feed system. For clarity purposes, no feed system from which cartridges can be loaded by loader 50 into hollow bore 46 of cartridge container 16 is shown in FIGS. 16-19. There are several possible ways of implementing such a system. It is understood that one skilled in the art shall be able to implement a feed system in the realizations shown in FIGS. 16-19. Loader 50 may fully cover the back of cartridge case 26 as shown in FIGS. 16 and 17, or only a portion thereof. Loader 50 may, but not necessarily, have an element or mechanism that can be used to initiate ignition of the propellant in cartridge case 26.

An example of an ignition initiation mechanism is shown in FIG. 19. Hammer 58 is pivotally mounted in frame 10 and urged to swing from the back (or battery) position to a firing position, in which it strikes firing pin 60. Firing pin 60, in turn, strikes the primer of the cartridge thereby initiating deflagration of the propellant in cartridge case 26. A release mechanism that controllably releases hammer 58 to make it swing to the firing position may be used in the firearm, but is not shown in FIG. 19 for clarity purposes.

For the convenience of reference, we will collectively call all parts that move in a direction substantially opposite the direction of projectile movement during firing an active mass. It should be noted that a part is considered a part of the active mass even if only a portion of that part moves in a direction substantially opposite the direction of projectile movement during firing. An example of such a part of the active mass, at least a portion of which moves during firing, is loader return spring 52. Thus, the active mass in FIGS. 16 through 18 includes cartridge container 16 with cartridge case 26 disposed at least partially therein during firing, loader 50, and loader return spring 52. The active mass of the firearm shown in FIG. 19 additionally includes firing pin 60 and hammer 58.

Similarly, we will collectively call all parts that move in substantially the same direction as the direction of projectile movement during firing a countermass. The same principle of partially moving parts applies to the countermass. In other words, a part is considered a part of the countermass even if only a portion of that part moves in substantially the same direction as the direction of projectile movement during firing. An example of a part of the countermass at least a portion of which moves during firing is countermass return spring 54. Thus, the countermass in FIGS. 16 through 19 comprises countermass main body 18, countermass return spring 54, and projectile 28.

It should also be noted that the propellant too, at least partially, moves during firing. When calculating the weight of the active mass and that of the countermass, one-half of the weight of the propellant is considered a part of the active mass, and the other half a part of the countermass.

Unlike in the single-shot design discussed in the Preferred Embodiment section above, countermass main body 18 in the automatic operation design consists of at least two separate members—first counteractor 181 and second counteractor 182—which are preferably disposed next to each other and capable of moving in a reciprocating fashion substantially along the axis line of barrel bore 34. In sum, in this embodiment the countermass 18 comprises the first counteractor 181 (having the countermass back surface 38 defining in part the firing chamber), and the second counteractor 182 located forward of, and separable from, the first counteractor. During firing of the ammunition, the countermass of the two counteractors 181, 182 moves in substantially the same direction as the projectile 28. The counteractors optionally are disposed coaxially around the barrel 12, but in all embodiments are disposed for reciprocating axial movement along the barrel.

When the firearm is in the battery position, the back end of first counteractor 181 (i.e. the end close to stand 30) is inserted into stand recess 44, generally as a male-to-female type of connector. The front end of first counteractor 181 preferably contacts the back end of second counteractor 182, so that the second counteractor is forward of and in contact with (but separable from) the first counteractor. During firearm operation, first counteractor 181 is capable of moving forward until it contacts first counteractor stop 56 and ceases its movement. First counteractor stop 56 is an element formed in frame 10 or immovably attached to frame 10 to limit the movement of first counteractor 181 in the forward direction. While moving forward, first counteractor 181 pushes and moves second counteractor 182 substantially in the same direction and against the urge of countermass return spring 54. Therefore, during firearm operation, second counteractor 182 receives momentum from first counteractor 181 and moves forward until it comes in contact with, and is stopped by, the frame frontal wall 11 and thereby ceases its movement. Thus, first counteractor 181 and second counteractor 182 move together in the forward direction until first counteractor 181 is stopped by first counteractor stop 56, after which second counteractor 182 continues moving until it is stopped by frame frontal wall 11.

The concept of the expandable chamber described above in the single-shot design is fully applicable to the automatic operation design. It can be well realized that in the two-member construction of countermass main body 18, a portion of first counteractor 181 constitutes a portion of the expandable chamber.

As previously stated, all parts that move during firing due to the energy of the high-pressure gas define the inert mass. Thus, the inert mass consists of the active mass and the countermass.

Figure 18:
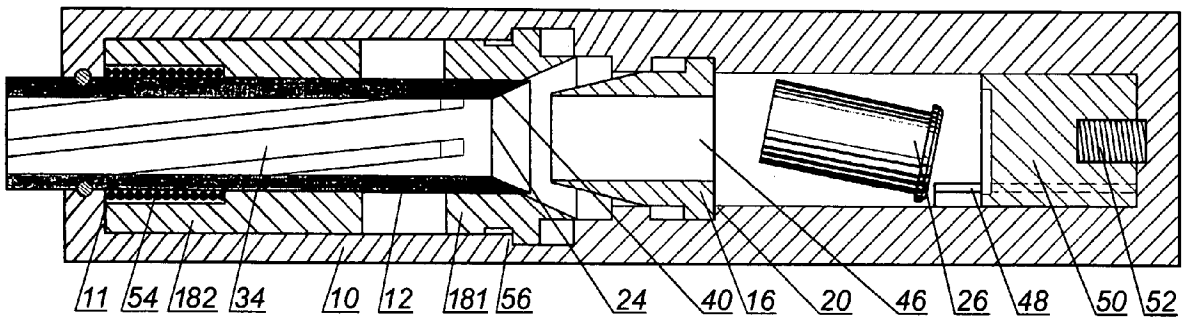
FIG. 18 is a schematic drawing similar to FIG. 17, showing the arrangement of parts of an apparatus according to the additional alternative embodiment of the present invention, after the projectile has left the muzzle and gas pressure in the barrel bore has dropped to a level safe for cartridge case extraction.

Side projection 48 serves the same function as in the Preferred Embodiment design, i.e. to change the direction of movement of cartridge case 26 when the latter exits hollow bore 46. Therefore, side projection 48 is located at a distance that allows cartridge case 26 to exit completely out of hollow bore 46 and become discarded from the firearm as shown in FIG. 18. Side projection 48 is preferably located on a side of the firearm's frame where it does not interfere with the movement of loader 50. Side projection 48 has an inverted L-shape. The dashed lines in loader 50 in FIGS. 16 through 19 represent a groove made in its side to allow loader 50 to move past side projection 48 without any interference.

Operation of the Additional Embodiment—FIGS. 16, 17, 18 and 19

This embodiment implements the process of automatic firing. It is, in general, similar to the single-shot design described in the Preferred Embodiment above, with the addition of operations of firearm reloading and after-firing stabilization. The operations of after-firing firearm stabilization are implemented in order to achieve minimal firearm displacement after the projectile has left the barrel bore, i.e. prior to the next discharge. Because of much similarity with operation of the single-shot embodiment discussed above, the description of the automatic operation will mainly be focused on those aspects that are either new or different from the operation of the single-shot embodiment.

FIG. 16 shows an arrangement of parts and placement of a cartridge in the firearm ready for firing. As in the case of the single-shot embodiment, the ignition of the cartridge propellant is performed in any way known in the art. Here, for example, a firing pin may be disposed in loader 50 and used via a release mechanism to controllably initiate ignition of the propellant. FIG. 19 shows one such possible solution: hammer 58 is controllably released via a release mechanism (not shown in FIG. 19) to swing from its back position to the firing position where it strikes firing pin 60 thereby initiating ignition of the propellant.

Upon ignition, deflagrating propellant produces a large amount of gas. High gas pressure develops in the expandable chamber and acts upon the surfaces exposed to the gas in the chamber. The elements having these surfaces and movable with respect to the frame begin to move: projectile 28 is propelled along barrel bore 34, cartridge container 16 substantially sealed by cartridge case 26 in its hollow bore 46 moves in a direction substantially opposite the direction of projectile movement (i.e. backward), and first counteractor 181 moves in substantially the same direction as the direction of projectile movement (i.e. forward).

As seen in FIG. 17, loader 50 is moved backward against the urge of loader return spring 52 by cartridge container 16. In general, loader 50 may as well be moved by cartridge case 26 or both—cartridge container 16 and cartridge case 26. At the same time, second counteractor 182 is moved forward against the urge of countermass return spring 54 by first counteractor 181. It is seen in FIG. 17 that cartridge container 16 does not contact cartridge container stop 20, and first counteractor 181 does not contact first counteractor stop 56 until after projectile 28 has exited barrel bore 34 and, preferably, the gas pressure in the expandable chamber has dropped to a predetermined level safe for cartridge case extraction.

The gas pressure in the expandable chamber also acts upon parts or elements immovable with respect to frame 10. Barrel 12 and stand 30 are such elements. The radial components of the forces acting upon the exposed surfaces of these elements cancel out and, therefore, do not tend to displace the firearm during firing. The longitudinal components of these forces, however, in general, tend to displace the firearm along its longitudinal axis line or around its center of mass if the center of mass of the firearm is not located on the firearm's longitudinal axis line. Therefore, it is important to make the oppositely directed net longitudinal force components equal in magnitude: they will substantially cancel out and bring the displacement of the firearm during firing to a minimum. This can be achieved by appropriately choosing the area of stand pressure surface 32 and that of the normal projection of breech end surface 40 onto a plane perpendicular to the axis line of barrel bore 34, as was explained in the operation section of the Preferred Embodiment.

Thus, the described design provides substantial cancellation of forces that reduces firearm displacement during firing to a technologically achievable minimum, resulting in a high accuracy of shooting. It is analogous to the technology of the single-shot operation discussed above.

To achieve accurate automatic firing, it is critical to keep the firearm as stable as possible not only while the projectile is moving in the barrel bore, but also after the projectile has exited the muzzle, so as to minimize the displacement of the firearm off the target prior to the next discharge.

As seen in FIG. 18, after projectile 28 has left barrel bore 34 and gas pressure in the barrel bore has dropped to a predetermined level safe for cartridge case extraction, cartridge container 16 is stopped by cartridge container stop 20 delivering an impact to frame 10 substantially in the backward direction. Approximately at the same time, first counteractor 181 is stopped by first counteractor stop 56 delivering an impact to frame 10 in a direction substantially opposite to that delivered to frame 10 by cartridge container 16. We will refer to these two oppositely directed impacts delivered to frame 10 as the first pair of impacts.

Having received momentum from cartridge container 16, loader 50 keeps moving in the backward direction against the urge of loader return spring 52 until it contacts the back wall of frame 10 delivering an impact to it. Similarly, second counteractor 182, having received momentum from first counteractor 181, keeps moving in the forward direction against the urge of countermass return spring 54 until it contacts frame frontal wall 11 delivering an impact to it in the direction opposite to that delivered to frame 10 by loader 50 and approximately at the same time when loader 50 hits the back wall of frame 10. We will refer to these two oppositely directed impacts delivered to frame 10 as the second pair of impacts.

The described two pairs of impacts delivered to frame 10 in substantially opposite directions compensate each other, so that the net force that acts upon frame 10 is minimal and so is displacement of the firearm after the discharge. In order for the two pairs of impacts to substantially cancel out each other, the following conditions for after-firing stabilization are to be met:

- The oppositely moving parts should contact frame 10 or elements immovable in relation to frame 10 at approximately the same time;
- The parameters of the oppositely moving parts that define their kinetic energy, such as their weights and speed of movement, should have such values that make the kinetic energy of the oppositely moving parts substantially equal at least at the time of delivering impacts to frame 10 or elements immovable in relation to frame 10;
- The vectors of the net forces applied by the moving parts to frame 10 due to the impacts should be oppositely directed and, preferably, lie on the same line to avoid creating a torque.

From these conditions, it follows that in order to minimize displacement of the firearm due to the impacts of the oppositely moving parts against frame 10 after the projectile has left barrel bore 34, the kinetic energy of cartridge container 16 with cartridge case 26 therein and that of first counteractor 181 should be substantially equal at least at the time when they contact cartridge container stop 20 and first counteractor stop 56, respectively. Similarly, the kinetic energy of loader 50 together with loader return spring 52 (including firing pin 60 in the realization in FIG. 19) and that of second counteractor 182 together with countermass return spring 54 should be substantially equal at least at the time when they contact the back wall of frame 10 and frame frontal wall 11, respectively.

In sum, the frontal wall 11 is on the frame axially between the muzzle end 22 and the breech end 24 of the barrel 12, and the first counteractor stop 56 is on the frame between the first counteractor 181 and the frontal wall 11. Consequently, after the projectile 28 exits the muzzle end 22, the first counteractor 181 contacts, and applies a first counteractor net impact force vector to, the counteractor stop 56 at substantially the same time the cartridge container 16 contacts, and applies a container net impact force vector to, the cartridge container stop 20. Likewise, after the projectile exits the muzzle end 22, the second counteractor 182 contacts, and applies a second counteractor net impact force vector to, the frontal wall 11 at substantially the same time the loader contacts and applies a loader net impact force vector to the back wall of the frame (FIG. 18). The first counteractor net impact force vector and the container net impact force vector preferably are collinear and oppositely directed, while the second counteractor net impact force vector and the loader net impact force vector also are collinear and oppositely directed. The counteractors 181, 182 have their respective masses while the cartridge case 26 and cartridge container 16 have their respective masses; the preferred embodiment is configured so that the kinetic energy of the forward moving first counteractor 181 is approximately equal to the sum of the kinetic energies of backwardly moving cartridge case 26 and cartridge container 16 at the instant in time that the first counteractor 181 contacts the counteractor stop 56. In a similar fashion, the preferred embodiment is configured so that the kinetic energy of the second counteractor 182 approximates the kinetic energy of the loader 50 at the time the second counteractor 182 contacts the front wall 11.

Again, the parameters of the moving parts that directly or indirectly affect the parts' kinetic energy, as well as the distance they move and the tension coefficients of the return springs, are chosen, applying known principles of physics, to satisfy the above conditions for after-firing stabilization. It is also preferable, although not necessary, that the center of mass of the "active mass" and that of the "countermass" be located on the axis line of barrel bore 34.

When cartridge container 16 hits cartridge container stop 20, loader 50 and cartridge case 26 keep moving in the backward direction by inertia. Loader 50 moves past side projection 48 until it hits the back wall of frame 10, while cartridge case 26 gets completely out of hollow bore 46 of cartridge container 16 and hits side projection 48. Upon impact with side projection 48, cartridge case 26 gets discarded from the firearm. Frame 10 may have an opening or window through which cartridge case 26 gets discarded. At this juncture, with the cartridge container 16 and the loader 50 axially separated, a second round of ammunition may be inserted (as from a conventional spring-driven magazine) into the apparatus between the loader 50 and the cartridge container 16; the loader is urged forward by the loader return spring 52 to push the new cartridge case toward the cartridge container 16, and the actions of the return springs 52, 54 return the apparatus to battery position. Thus, in automatic firing mode, the reciprocating loader 50 repeatedly is urged forward by the loader return spring 52 to push successive cartridge cases toward the cartridge container 16.

It is understood that cartridge case 26 gets out of hollow bore 46 no sooner than the gas pressure in the expandable chamber has reached a predetermined level safe for cartridge case extraction, as described in detail in the Preferred Embodiment section above. Continuing the discussion of the pressure drop in the expandable chamber started in the Preferred Embodiment section, it should be noted that this process can be expedited by making some structural modifications in the firearm. Such modifications may include making some additional gas escape vents in any part through which gas can flow from the expandable chamber preferably, but not necessarily, after projectile 28 has exited muzzle end 22. This will expedite the process of the pressure drop in the expandable chamber. Implementation of the expedited pressure drop may especially be important when designing a firearm with a high firing rate: the sooner the chamber pressure reaches a predetermined level safe for cartridge case extraction, the sooner the case extraction can be performed, and hence, the sooner the firearm can be reloaded with a new cartridge. It should also be noted that making one or more gas escape vents may create uncompensated radial force components, which may displace the firearm during firing. Some approaches to solving this problem may include the following. Vents can be made on opposite sides of the firearm so that the created radial force components will act in opposite directions and cancel out each other. Another approach may deal with an already existing uncompensated force acting in a radial direction. In this case, a vent or vents can be made in a side of the firearm where the produced radial force components will counterbalance the existing force.

From the foregoing description of operation, it can be realized that this design ensures firearm stability while the projectile is moving in the barrel bore, as well as after the projectile has left the barrel bore, thus providing very high accuracy of firing for the first and all subsequent shots in the automatic mode of firing.

Figure 20:
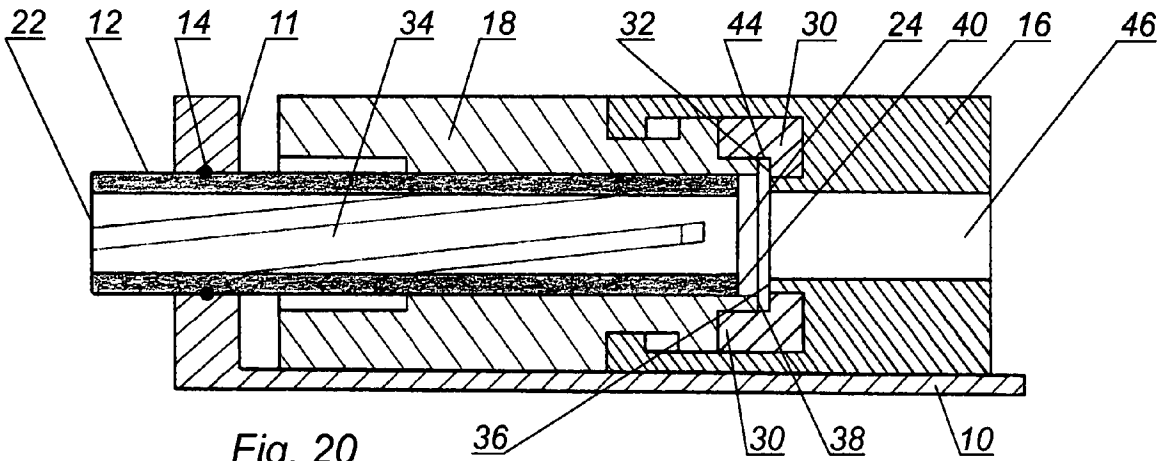
FIG. 20 is a schematic drawing of a partial side sectional view shown of a fourth special- or case or alternative embodiment of a firearm according to the present disclosure. The apparatus is shown in a position before firing ammunition.

FIG. 20—Fourth Special-Case Embodiment

FIG. 20 shows an embodiment of an automatic firearm apparatus in which impacts of the parts moving in the opposite directions are substantially cancelled out upon collision of the moving parts against each other during operation of the firearm. The operation of this firearm is otherwise similar to that described above for the Preferred Embodiment. This embodiment differs structurally from those described above by having cartridge container working surface 36, countermass back surface 38, and breech end surface 40 slanted at a right angle with respect to the axis line of the barrel bore. This structural difference results in minimal, if any, change in the functionality of the firearm and therefore will not be discussed here. Instead, focus is made on the after-firing stabilization method used in this embodiment.

Cartridge container 16 and countermass main body 18 have an L-shaped portion and an inverted L-shaped portion, respectively, facing each other as seen in the sectional view in FIG. 20. These portions come in contact when cartridge container 16 and countermass main body 18 move in their respective directions during firing. The collision of these two oppositely moving parts will result in substantial mutual cancellation of the parts' impacts against each other provided the following conditions are met: the parts' kinetic energies have to be as close in magnitude as possible at least at the moment of the collision, the parts should move in substantially opposite directions, and the center of mass of the individual oppositely moving parts should preferably, but not necessarily, be on the axis line of barrel bore 34. This means that parameters of the moving parts that affect their kinetic energy at the time of collision, such as their speed of movement and weight should be chosen accordingly to equalize their kinetic energies. An advantage of this embodiment over the embodiments described above is that the moving parts do not hit frame 10 and there is no need for precise adjustment of the timing of the collisions of the moving parts with frame 10.

Figure 21:
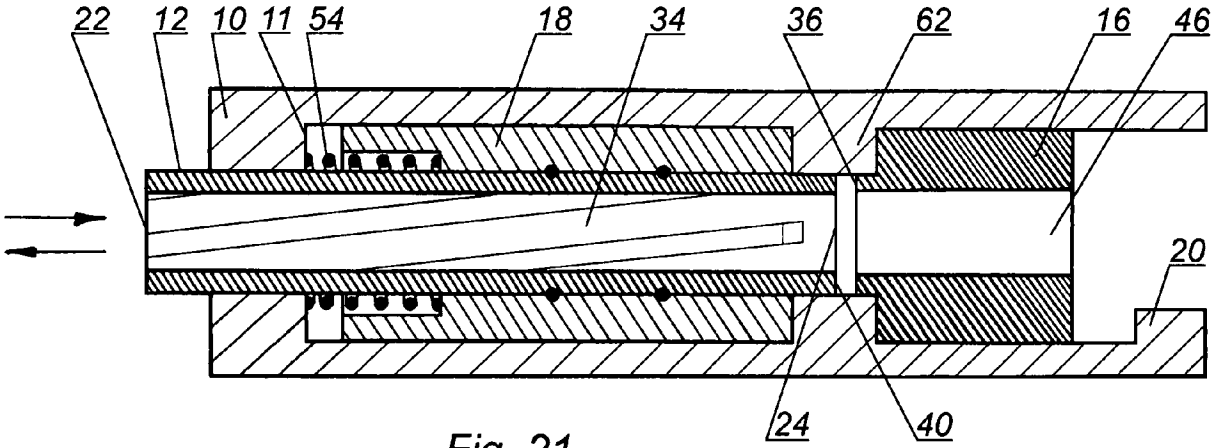
FIG. 21 is a schematic drawing of a partial side sectional view shown of yet another apparatus, featuring a movable barrel, according to the present disclosure.
Figure 22:
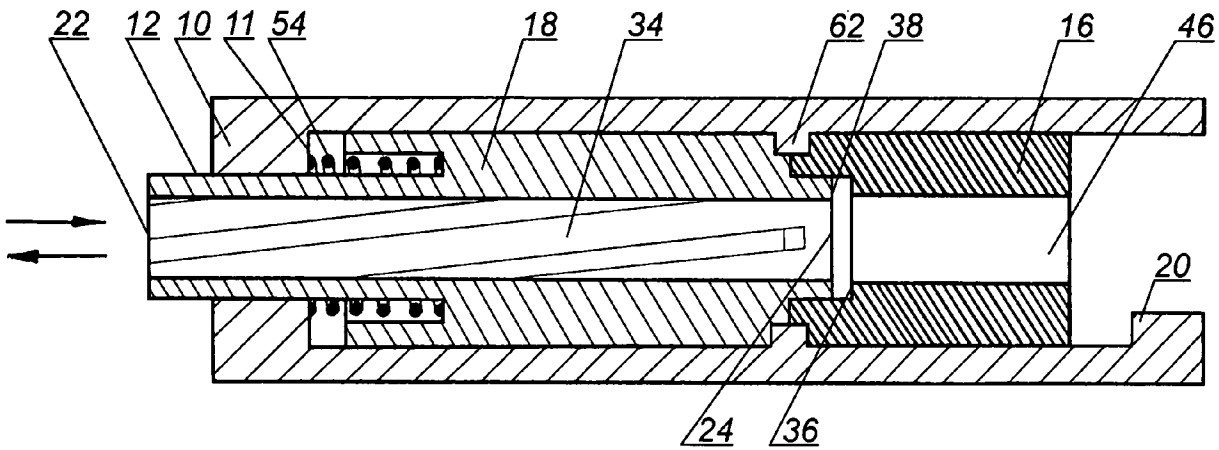
FIG. 22 is a schematic drawing of a partial side view, shown in section, of an alternative embodiment of the apparatus featuring a movable barrel integral with the countermass main body.

FIGS. 21 and 22—Alternative Embodiments

The alternative embodiments shown in FIGS. 21 and 22 feature two realizations of a firearm having a barrel movable with respect to the frame and immovably attached to countermass main body 18. Since the structure defines functionality, structural specifics of these embodiments are discussed first followed by their operation.

FIG. 21 schematically shows an embodiment of a firearm having the following main parts: frame 10, countermass main body 18, barrel 12 immovably mounted in countermass main body 18 with pins or any other immobilizing means, countermass return spring 54, cartridge container 16 with hollow bore 46 for the placement of ammunition therein, a rest 62, and cartridge container stop 20. The barrel has breech end 24 where a projectile enters barrel bore 34 and muzzle end 22 from which the projectile emerges.

In FIG. 21, all parts of the firearm are shown in a position ready for firing ammunition (ammunition is not shown in FIG. 21 for clarity purposes). To discharge the firearm, a cartridge or ammunition is loaded into hollow bore 46 of cartridge container 16. The cartridge propellant can be ignited by any means that will initiate the deflagration of the propellant. As was mentioned above, it can be a mechanical, laser-actuated, electrical, or any other means. FIG. 19 demonstrates an example of a device to mechanically initiate deflagration of the cartridge propellant.

Countermass main body 18 and barrel 12 immovably mounted therein form a unit that is capable of reciprocating motion substantially along the axis line of the barrel bore. The movement range of the unit is limited in the back position by rest 62 and in the front position by the front wall of frame 10. This unit is urged toward rest 62 by countermass return spring 54. Cartridge container 16 is capable of reciprocating motion substantially along the axis line of the barrel bore. The movement range of cartridge container 16 is limited in the back position by cartridge container stop 20 and in the front position by rest 62. Cartridge container 16 may also have a return spring for bringing cartridge container 16 to the initial position after a firing cycle is complete.

It is noted that the expandable chamber in this embodiment comprises fewer surfaces than the expandable chambers in the preferred and additional embodiments. Specifically, the expandable chamber is defined here by the following surfaces: cartridge container working surface 36, breech end surface 40, the surface of the interior of the cartridge case positioned in hollow bore 46 (the cartridge case is not shown in FIG. 21), a portion of the inner surface of rest 62 between cartridge container working surface 36 and breech end surface 40, the surface of the rear of the projectile, and the portion of the wall of barrel bore 34 between the rear of the projectile and breech end 24 (the projectile is not shown in FIG. 21).

FIG. 22 schematically shows an embodiment of a firearm structurally similar to that depicted in FIG. 21. This embodiment features barrel 12 and countermass main body 18 integrally made as a single-piece unit. In the battery position, the back end of the single-piece unit is inserted into the front end of cartridge container 16 generally as a male-to-female type of connector (a cartridge is not shown in the firearm in FIG. 22 for clarity purposes). Rest 62 limits movement of the single-piece unit backward and that of cartridge container 16 forward. In the battery position, the single-piece unit and cartridge container 16 rest against rest 62. Frame frontal wall 11 limits the movement of the single-piece unit forward; cartridge container stop 20 limits the movement of cartridge container 16 backward. The expandable chamber is defined by the same surfaces as in the embodiment in FIG. 21, with the exception that the inner, frontal, and back surfaces of rest 62 become portions of the expandable chamber at some stage during the process of firing when the respective moving parts—the single-piece unit and cartridge container 16—move in their respective directions and expose rest 62 to the gas. In general, the width of rest 62 and the range of movements of the single-piece unit and cartridge container 16 in their respective directions may be chosen so that no portion of rest 62 or only the inner wall of rest 62 becomes exposed to gas pressure at some stage during the process of firing.

Operation of the Alternative Embodiments—FIGS. 21 and 22

The alternative embodiments shown in FIGS. 21 and 22 are very similar in operation; therefore, the following description of operation is referred to both implementations, unless stated otherwise. Since the operation of the alternative embodiments is similar to the operation of the preferred and additional embodiments, focus will be made on the aspects specific to the operation of the alternative embodiments.

A cartridge or ammunition is loaded into hollow bore 46 of cartridge container 16. The cartridge may be fed from a feed system or any other supply means (in case of automatic firing, a loader similar to that described in the additional embodiment may be used). Once the cartridge is positioned in hollow bore 46, and the moving parts—barrel 12 with countermass main body 18 and cartridge container 16—are in the positions shown in FIGS. 21 and 22, the firearm is ready for firing. As discussed above, ignition of the cartridge propellant can be performed by any means which will initiate the deflagration of the propellant. The deflagrating propellant produces gas which fills the space in the cartridge case, expels the projectile from the mouth of the cartridge case, and fills the available space (the propellant, cartridge case, and projectile are not shown in FIGS. 21 and 22 for clarity purposes). If the projectile is not attached to the cartridge case prior to the ignition of the propellant, gas starts filling the available space outside the cartridge case as soon as the deflagration of the propellant is initiated. Driven by the developed gas pressure, the projectile enters barrel bore 34 at its breech end 24 (if it already at least partially was not positioned there) and the gas fills the expandable chamber. High gas pressure propels the propellant along barrel bore 34 and acts upon the surfaces in the expandable chamber. Thus, the gas pressure creates forces acting upon those surfaces and proportional to the surface areas. Force components acting in planes perpendicular to the axis line of barrel bore 34 cancel out and do not tend to displace the firearm during firing. These force components also act upon the inner surface of the wall of the cartridge case pressing it against the wall of hollow bore 46. Force components acting along or parallel to the axis line of barrel bore 34 act upon the following surfaces: the back of the projectile propelling it along barrel bore 34, breech end surface 40 (FIG. 21) or countermass back surface 38 (FIG. 22) pushing barrel 12 and countermass main body 18 in the forward direction, and cartridge container working surface 36 and the inner bottom portion of the cartridge case opposite its open end pushing cartridge container 16 with the cartridge case in the backward direction.

It is important to choose appropriately the moving parts' surface areas exposed to the gas, as well as the parts' weight and speed of movement, so that the moving parts do not transfer energy to frame 10 or any part immovable with respect to frame 10 before projectile leaves muzzle end 22 of barrel bore 34 (to simplify the discussion, we do not consider here energy transferred to frame 10 due to the tension coefficient of countermass return spring 54 and friction of the moving parts against surfaces of frame 10 or parts immovable with respect to frame 10). That is, countermass main body 18 with barrel 12 should reach the front wall of frame 10 and cartridge container 16 should reach cartridge container stop 20 no sooner than the projectile leaves muzzle end 22. After the projectile has left muzzle end 22, countermass main body 18 with barrel 12 ceases its movement by contacting the front wall of frame 10 and cartridge container 16 ceases its movement by contacting cartridge container stop 20. By this time, the gas pressure has dropped to a level safe for cartridge case extraction. The cartridge case is no longer firmly pressed against the inner wall of hollow bore 46. When cartridge container 16 contacts cartridge container stop 20, cartridge case keeps moving backward by inertia, thereby leaving hollow bore 46. This completes the firing cycle. If the firearm is to be used in automatic mode of firing, it should also remain as stable as possible after the projectile has left muzzle end 22. In order to achieve this, the conditions for after-firing stabilization stated above in the description of the additional embodiment have to be met.

INDUSTRIAL APPLICABILITY OF THE INVENTION

The operability of the disclosed invention has been verified by building and testing a working model of a large-caliber pistol constructed according to the present invention. A series of tests was conducted using ammunition with energies ranging from 300 to 700 Joules. The results of the tests have successfully corroborated the key concepts disclosed in this application.

The preceding examples can be repeated with similar success by substituting the generically or specifically described reactants and/or operating conditions of this invention for those used in the preceding examples.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

We claim:

1. An apparatus for firing ammunition, the ammunition comprising a cartridge case and a projectile, said apparatus comprising:

a frame;

a barrel immovably affixed to said frame and having:

an axis; and a muzzle end and a breech end defining a breech end surface;

a cartridge container, movable axially in relation to said barrel, for receiving therein at least a portion of the cartridge case, said cartridge container having a working surface;

a stand member, immovable in relation to said frame, comprising a stand pressure surface; and wherein during firing of the ammunition, a chamber is defined in part by said breech end surface, said working surface, and said stand pressure surface; and wherein during firing of the ammunition, gases expand in said chamber to move the projectile forward to exit said muzzle end and to move said cartridge case and cartridge container axially backward in a direction substantially opposite the direction of projectile movement; and further wherein during firing, gas pressure in said chamber applies oppositely directed net axial forces upon said apparatus, cartridge case, and projectile.

2. An apparatus according to claim 1 wherein said net axial forces include a forwardly directed force component upon said breech end surface and a backwardly directed force component upon said stand pressure surface; and wherein the area of a normal projection of said breech end surface onto a plane perpendicular to said axis is proportional to the area of a normal projection of said stand pressure surface onto a plane perpendicular to said axis, approximately to equalize in magnitude said oppositely directed net axial forces.

3. An apparatus according to claim 1 wherein said cartridge container is disposed coaxially within said stand for reciprocating axial movement therein.

4. An apparatus according to claim 3 further comprising an inner surface of said cartridge case, wherein said gas pressure acts upon said inner surface of said cartridge case, and wherein said cartridge case expands in, and co-accelerates with, said cartridge container, thereby said cartridge case at least partially retains in said cartridge container during firing.

5. An apparatus according to claim 1 further comprising a countermass movable axially in relation to said barrel, and having a countermass back surface defining in part said chamber during firing, and wherein during firing of the ammunition said countermass moves in substantially the same direction as the projectile.

6. An apparatus according to claim 5 wherein said countermass is disposed coaxially with, and at least in part around, said barrel for reciprocating axial movement along said barrel.

7. An apparatus according to claim 5 wherein during firing gas pressure in said chamber applies directionally opposite forces upon said countermass back surface and upon said cartridge container working surface.

8. An apparatus according to claim 7 further comprising an active mass, said active mass comprising said cartridge container and said cartridge case, wherein said countermass has a mass and said active mass has a mass, and wherein after the projectile exits said muzzle end, a kinetic energy of said countermass approximates a kinetic energy of said active mass.

9. An apparatus according to claim 7 wherein after the projectile exits said muzzle end, said active mass and said countermass cease their respective movements with respect to said frame at approximately the same time.

10. An apparatus according to claim 8 further comprising:

a frontal wall on said frame forward of said breech end of said barrel; and a movement-arresting member on said frame for arresting backward movement of said active mass;

wherein after said projectile exits said muzzle end, said countermass contacts, and applies a countermass net impact force vector to, said frontal wall at approximately the same time said active mass contacts and applies an active mass net impact force vector to, said movement-arresting member.

11. An apparatus according to claim 1 wherein a normal projection of said stand pressure surface onto an imaginary plane perpendicular to said axis is annular.

12. An apparatus according to claim 5 wherein normal projections of said cartridge container working surface, said breech end surface, and said countermass back surface onto an imaginary plane perpendicular to said axis are annular.

13. An apparatus according to claim 12 wherein:

said cartridge container working surface is annular and slanted at a container surface angle in relation to said axis;

said countermass back surface is annular and slanted at a countermass surface angle in relation to said axis; and wherein said container surface angle, said countermass surface angle, and said breech surface angle are substantially equal.

14. An apparatus according to claim 12 wherein said cartridge container working surface is defined within an imaginary plane normal to said axis, and further wherein said cartridge container working surface contacts said breech end surface when said apparatus is in a battery position.

15. An apparatus according to claim 1 wherein said breech end surface comprises a member removably connected to said breech end of said barrel, and further comprising an annulus washer removably disposed forward of and immediately proximate to said stand member.

16. A method of operating an apparatus for firing ammunition comprising the steps of:

providing the firearm apparatus comprising:

a frame;

a barrel immovably affixed to said frame and having:

an axis; and a muzzle end and a breech end defining a breech end surface;

a cartridge container, movable axially in relation to said barrel, for receiving therein at least a portion of the cartridge case, said cartridge container having a working surface;

a stand member, immovable in relation to said frame, comprising a stand pressure surface;

providing ammunition comprising a projectile and a cartridge case;

loading the ammunition in the firearm apparatus so that at least a portion of the cartridge case resides in the cartridge container;

defining a chamber during firing in part by the breech end surface, working surface, and stand pressure surface;

permitting gases to expand in the chamber to move the projectile forward to exit the muzzle end and to move the cartridge case and cartridge container backward in a direction substantially opposite the direction of projectile movement; and wherein during firing, gas pressure in the chamber applies oppositely directed net axial forces upon the apparatus, cartridge case, and projectile.

17. A method of claim 16 wherein said net axial forces include a forwardly directed force component upon said breech end surface and a backwardly directed force component upon said stand pressure surface; and wherein the area of a normal projection of said breech end surface onto a plane perpendicular to said axis is proportional to the area of a normal projection of said stand pressure surface onto a plane perpendicular to said axis, approximately to equalize in magnitude said oppositely directed net axial forces.

18. A method of claim 16 further comprising the step of providing an inner surface of said cartridge case, wherein said gas pressure acts upon said inner surface of said cartridge case, and wherein said cartridge case expands in, and co-accelerates with, said cartridge container, thereby said cartridge case at least partially retains in said cartridge container during firing.

19. A method of claim 16 further comprising the step of providing a countermass movable axially in relation to said barrel and having a countermass back surface defining in part said chamber during firing, and wherein during firing of the ammunition said countermass moves in substantially the same direction as the projectile.

20. A method of claim 19 wherein during firing, gas pressure in said chamber applies directionally opposite forces upon said countermass back surface and upon said cartridge container working surface.

21. A method of claim 20 further comprising the step of providing an active mass, said active mass comprising said cartridge container and said cartridge case, wherein said countermass has a mass and said active mass has a mass, and wherein after the projectile exits said muzzle end, a kinetic energy of said countermass approximates a kinetic energy of said active mass.

22. A method of claim 20 wherein after the projectile exits said muzzle end, said active mass and said countermass cease their respective movements with respect to said frame at approximately the same time.

23. A method of claim 21 further comprising the step of providing:

a frontal wall on said frame forward of said breech end of said barrel; and a movement-arresting member on said frame for arresting backward movement of said active mass;

wherein after said projectile exits said muzzle end, said countermass contacts, and applies a countermass net impact force vector to, said frontal wall at approximately the same time said active mass contacts and applies an active mass net impact force vector to, said movement-arresting member.

24. An apparatus for firing ammunition, the ammunition having a cartridge case and a projectile, said apparatus comprising:

a frame;

a barrel immovably affixed to said frame and having:

an axis; and a muzzle end and a breech end defining a breech end surface;

a cartridge container, movable axially in relation to said barrel, for receiving therein at least a portion of the cartridge case, said cartridge container having a working surface;

a stand member, immovable in relation to said frame, comprising a stand pressure surface;

a loader disposed backward of said cartridge container for reciprocating axial movement in relation to said frame;

a loader return spring means for urging said loader toward said cartridge container; and a back wall means on said frame for stopping backward axial movement of said loader;

wherein during firing of the ammunition, a chamber is defined in part by said breech end surface, said working surface, and said stand pressure surface;

wherein during firing of the ammunition, gases expand in said chamber to move the projectile forward to exit said muzzle end, and said cartridge case and cartridge container move axially backward in a direction substantially opposite the direction of projectile movement; and wherein during firing, gas pressure in said chamber applies oppositely directed net axial forces upon said apparatus, cartridge case, and projectile; and further wherein during firing, said loader receives momentum from the backward movement of said cartridge container, causing said loader to move backward against said loader return spring means until said loader is stopped by said back wall means.

25. The apparatus of claim 24 further comprising a cartridge container stop, on said frame between said cartridge container and said back wall means, for stopping backward movement of said cartridge container, wherein backward movement of said container is stopped by said container stop before said loader contacts and is stopped by said back wall means, thereby separating said loader from said container.

26. The apparatus of claim 24 further comprising:

a firing pin in said loader and contactable with the cartridge case; and a hammer disposed for striking said firing pin.

27. The apparatus of claim 25 wherein when said container is stopped by said container stop, said cartridge case is ejected from said container.

28. The apparatus of claim 27 wherein said loader is urged forward by said loader return spring to push another cartridge case toward said cartridge container.

29. The apparatus of claim 25 wherein said net axial forces include a forwardly directed force component upon said breech end surface and a backwardly directed force component upon said stand pressure surface; and wherein the area of a normal projection of said breech end surface onto a plane perpendicular to said axis is proportional to the area of a normal projection of said stand pressure surface onto a plane perpendicular to said axis, approximately to equalize in magnitude said oppositely directed net axial forces.

30. The apparatus of claim 29 further comprising a countermass movable axially in relation to said barrel, said countermass comprising:

a first counteractor having a countermass back surface defining in part said chamber during firing; and a second counteractor forward of and separable from said first counteractor;

wherein during firing of the ammunition said countermass moves in substantially the same direction as the projectile.

31. The apparatus of claim 30 wherein during firing, gas pressure in said chamber applies directionally opposite forces upon said countermass back surface and upon said cartridge container working surface.

32. The apparatus of claim 31 further comprising:

a frontal wall on said frame forward of said breech end of said barrel; and a first counteractor stop on said frame between said breech end of said barrel and said frontal wall;

wherein after the projectile exits said muzzle end, said first counteractor contacts, and applies a first counteractor net impact force vector to, said counteractor stop at substantially the same time said cartridge container contacts and applies a container net impact force vector to, said cartridge container stop; and wherein after the projectile exits said muzzle end, said second counteractor contacts, and applies a second counteractor net impact force vector to, said frontal wall at substantially the same time said loader contacts and applies a loader net impact force vector to, said back wall means.

33. The apparatus of claim 32 wherein said counteractors have respective masses, and the cartridge case and cartridge container have respective masses, and wherein a kinetic energy of said first counteractor approximates a sum of kinetic energies of the cartridge case and said cartridge container at the time said first counteractor contacts said counteractor stop.

34. The apparatus of claim 33 wherein said loader has a mass, and wherein a kinetic energy of said second counteractor approximates a kinetic energy of said loader at the time said second counteractor contacts said frontal wall.

* * * * *